US007647005B2

(12) United States Patent
Takagi

(10) Patent No.: US 7,647,005 B2
(45) Date of Patent: Jan. 12, 2010

(54) PROCESS UNIT, TONER BOX AND IMAGE FORMING APPARATUS

(75) Inventor: Takeyuki Takagi, Nagoya (JP)

(73) Assignee: Brother Kogyo Kabushiki Kaisha (JP)

( * ) Notice: Subject to any disclaimer, the term of this patent is extended or adjusted under 35 U.S.C. 154(b) by 129 days.

(21) Appl. No.: 11/689,903

(22) Filed: Mar. 22, 2007

(65) Prior Publication Data

US 2007/0223964 A1 Sep. 27, 2007

(30) Foreign Application Priority Data

Mar. 27, 2006 (JP) ..... 2006-085924
Sep. 28, 2006 (JP) ..... 2006-264689
Jan. 22, 2007 (JP) ..... 2007-011598

(51) Int. Cl.
*G03G 21/18* (2006.01)
*G03G 15/08* (2006.01)

(52) U.S. Cl. ..... 399/113; 399/120; 399/262

(58) Field of Classification Search ..... 399/120, 399/119, 111, 113, 262
See application file for complete search history.

(56) References Cited

U.S. PATENT DOCUMENTS 4,913,087 A 4/1990 Saita et al.
5,568,237 A 10/1996 Ishida et al.
5,587,777 A * 12/1996 Miyaji et al. ..... 399/120
5,608,501 A 3/1997 Makino
5,614,996 A 3/1997 Tanda
5,659,837 A 8/1997 Jo
5,809,384 A 9/1998 Johroku et al.
7,242,893 B2 7/2007 Murakami et al.
7,266,330 B2 9/2007 Murakami et al.
7,437,095 B2 * 10/2008 Shimomura et al. ..... 399/119
2002/0181969 A1 12/2002 Terada et al.
2004/0047657 A1 3/2004 Nagashima et al.
2005/0135842 A1 6/2005 Murakami et al.
2005/0271425 A1 * 12/2005 Shimomura et al. ..... 399/258
2007/0223971 A1 * 9/2007 Takagi ..... 399/258

FOREIGN PATENT DOCUMENTS

CN 1627202 A 6/2005
CN 1222848 C 10/2005
EP 0 608 812 A2 8/1994
EP 0 668 546 A2 8/1995

(Continued)

OTHER PUBLICATIONS

Office Action dated Aug. 19, 2008 from U.S. Appl. No. 11/686,434.

(Continued)

*Primary Examiner*—Sophia S Chen
(74) *Attorney, Agent, or Firm*—Banner & Witcoff, Ltd.

(57) ABSTRACT

A process unit is described. The process unit may include a unit main body being detachably mountable to an image forming apparatus main body and having a developer carrier for supplying a developing agent to an image carrier on which an electrostatic latent image is formed, a toner box being detachably mountable to the unit main body and accommodating the developing agent, a pivoting member pivotably disposed at the unit main body, and a contacting member disposed at the pivoting member and contacting with the toner box from a downstream side in a detaching direction of the toner box from the unit main body.

15 Claims, 13 Drawing Sheets

FOREIGN PATENT DOCUMENTS

| | | | |
|---|---|---|---|
| EP | 1 241 536 | A2 | 9/2002 |
| EP | 1 542 091 | A1 | 6/2005 |
| EP | 1 241 536 | A3 | 4/2006 |
| EP | 1 722 279 | A1 | 11/2006 |
| JP | 61022366 | A | 1/1986 |
| JP | 61022367 | A | 1/1986 |
| JP | 1021469 | A | 1/1989 |
| JP | 3075769 | A | 3/1991 |
| JP | 04-350870 | A | 4/1992 |
| JP | 4350870 | A | 12/1992 |
| JP | 2864951 | B2 | 2/1995 |
| JP | 7225514 | A | 8/1995 |

OTHER PUBLICATIONS

CN Office Action dtd Sep. 5, 2008, CN Appln. 200710089700.2.

Extended European Search Report dated Aug. 16, 2007 in Application No. 07006097.5.

CN Office Action dtd Oct. 10, 2008, CN Appln. 200710091677.0, English translation only.

* cited by examiner

FIG. 4 ( a )
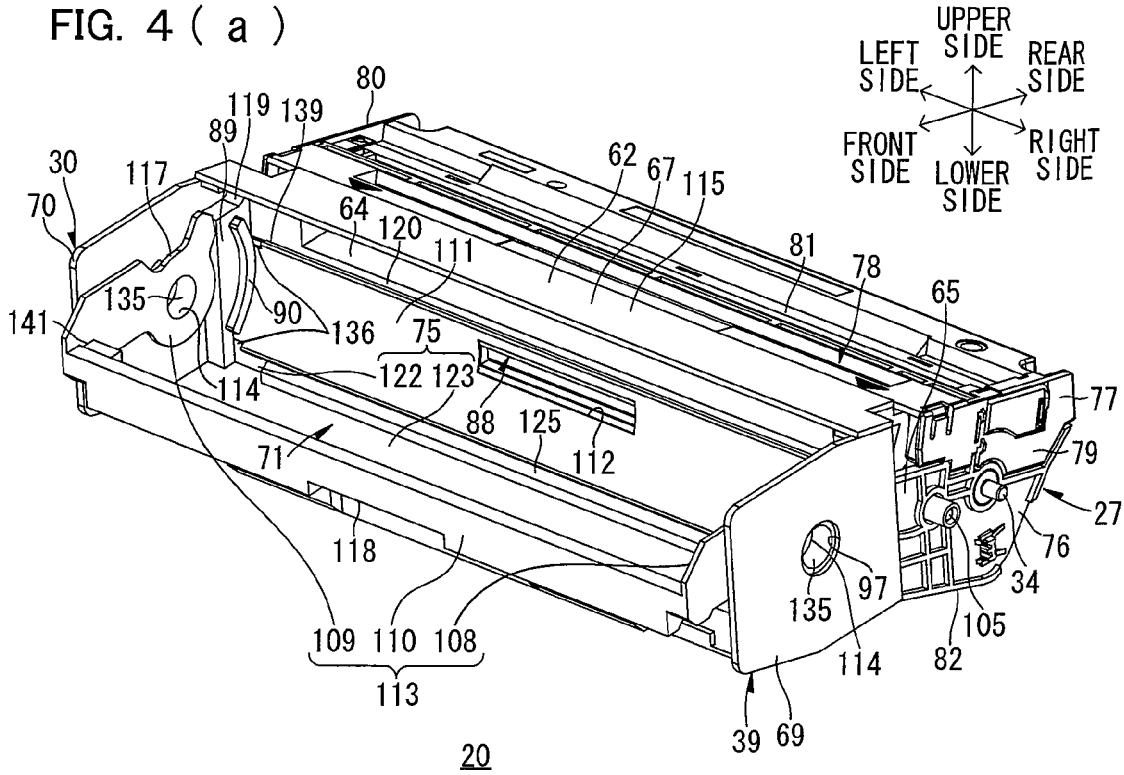
FIG. 4 ( b )
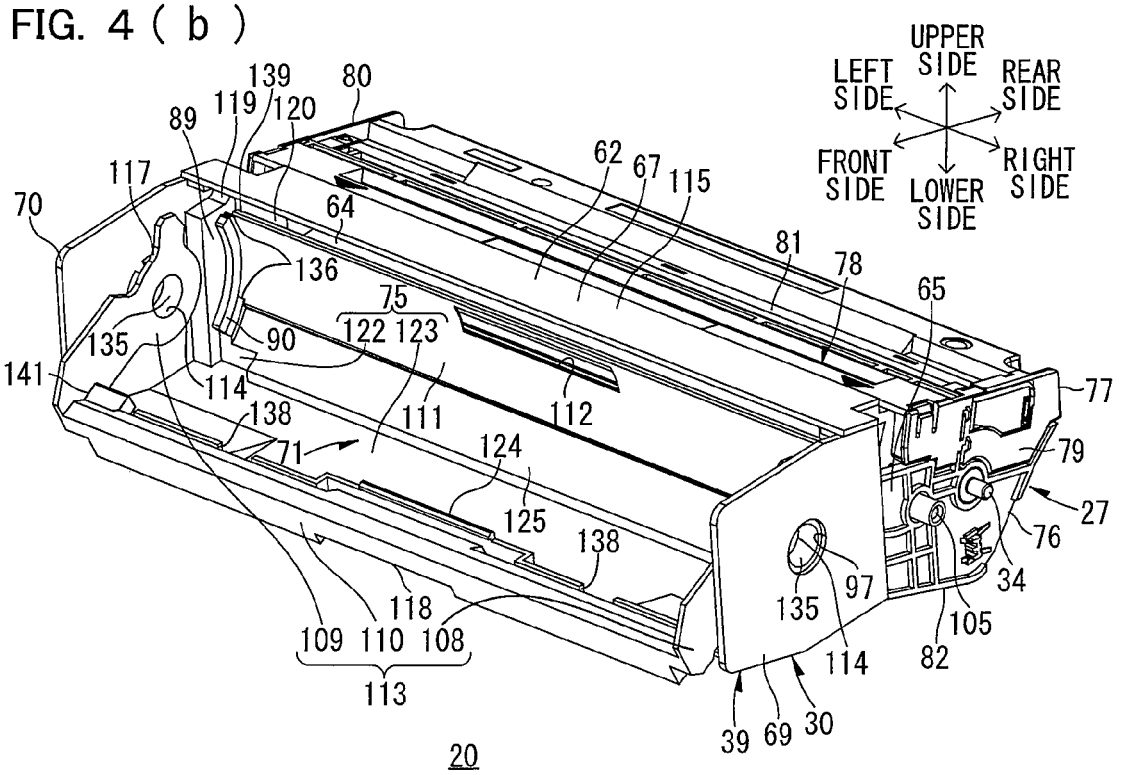

FIG. 5 ( a )
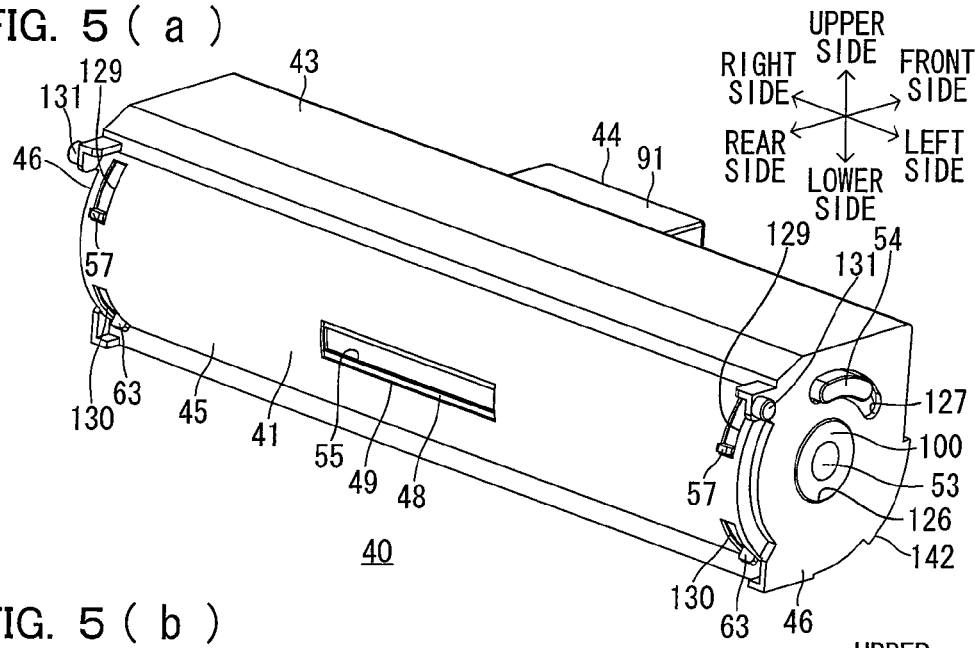
FIG. 5 ( b )
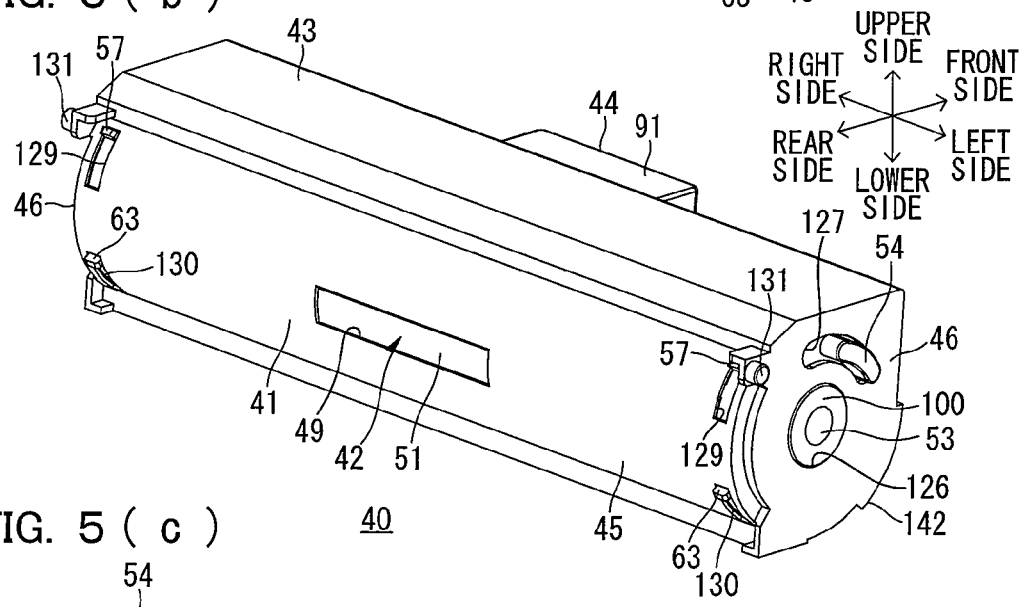
FIG. 5 ( c )
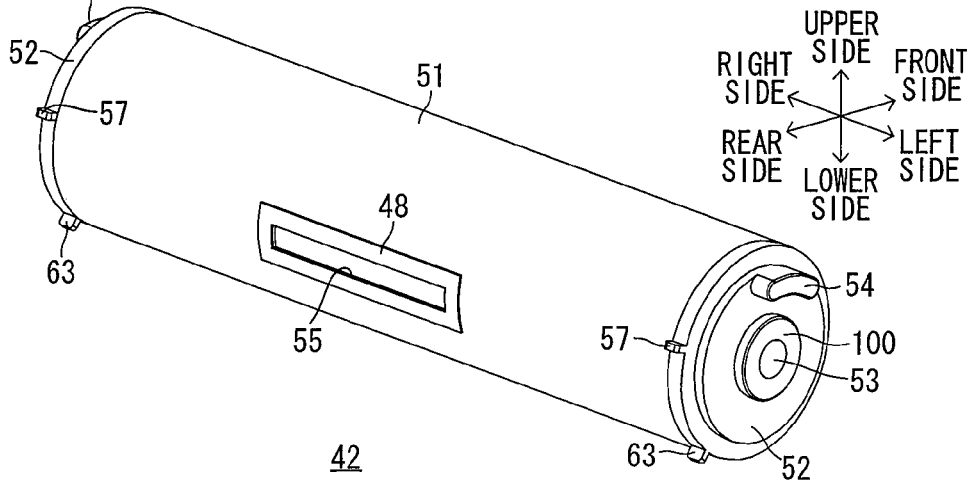

UPPER SIDE
FRONT SIDE
REAR SIDE
LOWER SIDE 113
110
20
30
147
141
142
143
144
146
43
54
100
53
127
42
126
40
41
131
46
45
63
57

UPPER SIDE
FRONT SIDE
REAR SIDE
LOWER SIDE 20
30
40
41
42
43
45
46
53
54
57
63
100
110
113
126
127
131
141
142
143
144
146
147

PROCESS UNIT, TONER BOX AND IMAGE FORMING APPARATUS

CROSS REFERENCE TO RELATED APPLICATIONS

This application claims priority benefits on the basis of Japanese Patent Application No. 2006-85924 filed on Mar. 27, 2006, Japanese Patent Application No. 2006-264689 filed on Sep. 28, 2006, and Japanese Patent Application No. 2007-11598 filed on Jan. 22, 2007, the disclosures of which are incorporated herein by reference.

BACKGROUND OF THE INVENTION

1. Field

Aspects of the present invention relates to an image forming apparatus such as a laser printer and to a process unit and a toner box which can be mounted to and removed from the image forming apparatus.

2. Description of the Related Art

A process unit of a laser printer has been proposed, in which a toner box is detachably mountable to the unit main body of the process unit.

In some developing unit, a toner box is detachably mountable to the case of the developing unit. The case of the developing unit is formed with an anti-slip-off guide groove. In the toner box, a lever is pivotably provided with respect to a spindle which projects transversely from both right and left sides thereof and rotates a rotary vane, and an engaging projection is disposed at the substrate of the lever through which the spindle is passed. In the developing unit, a toner box is attached to the case of the developing unit, and the lever is pivoted about the spindle to fit an engaging projection into the anti-slipping guide groove, so that the lever and the toner box cannot come off from the case of the developing unit and the attached state of the toner box in the case of the developing unit can be maintained.

In the developing unit, the engaging position of the engaging projection of the toner box with the anti-slip-off guide groove of the case of the developing unit is located on both right and left sides of the toner box, but not located on the downstream side in the detaching direction of the toner box from the case of the developing unit. In other words, there are no restrictions on the relative movement of the toner box attached in the case of the developing unit, in relation to the case of the developing unit on the downstream side in the detaching direction in relation to the toner box.

Therefore, the attached state of the toner box in the case of the developing unit may not be reliably maintained when a force is applied to the toner box to move the toner box in the detaching direction.

SUMMARY

One aspect of the present invention may provide a process unit which can reliably maintain the attached state of the toner box in the unit main body, a toner box detachably mountable to the process unit, and an image forming apparatus to which the process unit and the toner box are detachably mountable.

The same or different aspect the present invention may provide a process unit including: a unit main body being detachably mountable to an image forming apparatus main body and having a developer carrier for supplying a developing agent to an image carrier on which an electrostatic latent image is formed; a toner box being detachably mountable to the unit main body and accommodating the developing agent; a pivoting member pivotably disposed at the unit main body; and a contacting member disposed at the pivoting member and contacting with the toner box from a downstream side in a detaching direction of the toner box from the unit main body.

One or more aspects of the present invention provide an image forming apparatus including: an image forming apparatus main body; and a process unit detachably mountable to the image forming apparatus main body, wherein the process unit includes: a unit main body being detachably mountable to the image forming apparatus main body and having a developer carrier for supplying a developing agent to an image carrier on which an electrostatic latent image is formed; a toner box being detachably mountable to the unit main body and accommodating the developing agent; a pivoting member pivotably disposed at the unit main body; and a contacting member disposed at the pivoting member and contacting with the toner box from a downstream side in a detaching direction of the toner box from the unit main body, the pivoting member can pivot between a contacting position in which the contacting member contacts with the toner box attached in the unit main body and a release position in which contact of the contacting member with the toner box is released, the image forming apparatus main body is formed with an opening for passing the process unit therethrough and has a cover for covering the opening in an openable and closable manner, and the pivoting member interferes with the cover when the opening is closed by the cover in a state where the unit main body and the toner box are attached in the image forming apparatus main body in cases other than a case where the pivoting member is located at the contacting position.

One or more aspects of the present invention provide a toner box detachably mountable to a unit main body including a developer carrier and accommodating a developing agent, including: a first casing formed with a first opening for supplying the developing agent to the unit main body; a first blocking member for opening and closing the first opening; and a vibration applying unit for applying vibration to the first blocking member at a time of opening and closing of the first blocking member.

BRIEF DESCRIPTION OF THE DRAWINGS

FIGS. 4(*a*) and 4(*b*) show aspects where a toner box has been detached in FIG. 2, and FIG. 4(*a*) shows an open/close lever being at a contacting position to open a toner guiding port, and FIG. 4(*b*) shows the open/close lever being at a release position to close the toner guiding port.

FIGS. 5(*a*), 5(*b*), and 5(*c*) are left perspective views of a toner box in the process unit shown in FIG. 2 as viewed from above the rear side, FIG. 5(*a*) shows an aspect where a toner ejecting port is opened, FIG. 5(*b*) shows an aspect where the toner ejecting port is closed, and FIG. 5(*c*) shows an inner casing in the toner box.

DETAILED DESCRIPTION OF THE EMBODIMENTS

Details of embodiments of one or more aspects of the present invention will be described hereinafter with reference to the drawings.

First Embodiment

1. Overall Configuration of Laser Printer

Figure 1:
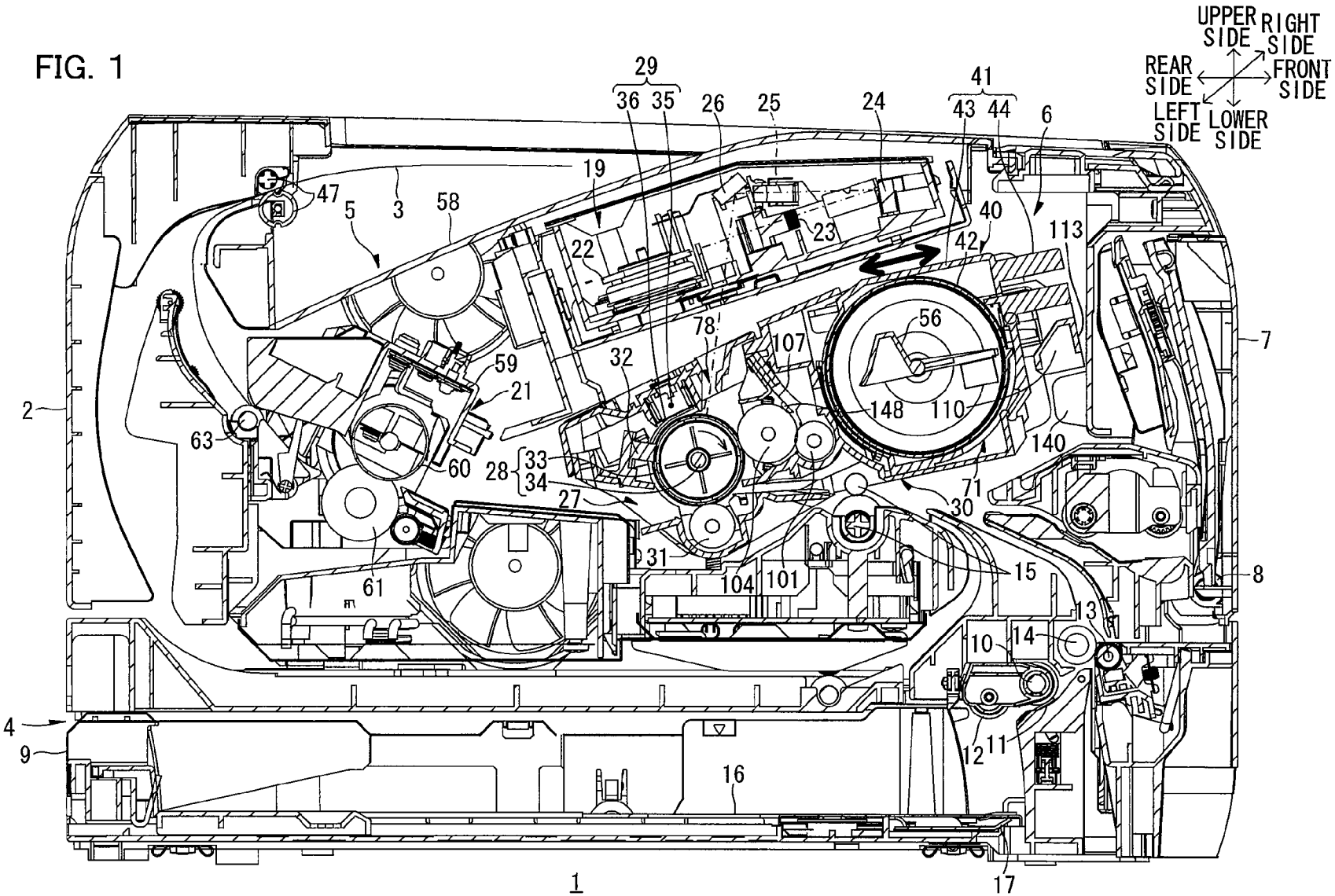
FIG. 1 is a sectional side view showing an embodiment of a laser printer as an example of an image forming apparatus of one or more aspects of the present invention.

FIG. 1 is a sectional side view showing an embodiment of a laser printer as an example of an image forming apparatus of one or more aspects of the present invention.

The laser printer 1 includes a main body casing 2 as an example of an image forming apparatus main body, a sheet feeding section 4 accommodated in the main body casing 2 for feeding a sheet 3, and an image forming section 5 for forming an image on the fed sheet 3, as shown in FIG. 1.

(1) Main Body Casing

On a side wall on one side of the main body casing 2, a mounting port 6 is formed as an example of an opening to allow a process unit 20 described later to pass therethrough during attaching and detaching of the process unit 20, and a front cover 7 is provided as an example of a cover that covers the mounting port 6 in an openable and closable manner.

In the following description, the side on which the front cover 7 is provided will be described as a "front side" (front face side) and the opposite side thereof will be described as a "rear side" (back face side) in the state where the process unit 20 is attached in the main body casing 2. The near side of the sheet thickness direction in FIG. 1 will be described as a "left side" and the far side of the sheet thickness direction in FIG. 1 will be described as a "right side". In some cases, the left and right direction may be referred to as a "width direction".

The front cover 7 is pivotably supported by a cover shaft 8 provided at the lower end portion thereof. When the front cover 7 is closed with the cover shaft 8 as a supporting point, the front cover 7 closes the mounting port 6, and when the front cover 7 is opened with the cover shaft 8 as a supporting point, the mounting port 6 is opened and the process unit 20 can be attached to and detached from the main body casing 2 via the mounting port 6.

Moreover, the front cover 7 is provided with an intervening portion 140.

The intervening portion 140 is formed so as to protrude rearward from the rear side surface of the front cover 7 at a closed state, in other words, protrude inward toward the inside of the main body casing 2.

(2) Sheet Feeding Section

The sheet feeding section 4 is disposed at the bottom in the main body casing 2 and includes a sheet feeding tray 9, a separation roller 10, a separation pad 11, a sheet feeding roller 12, a sheet dust removing roller 13, a pinch roller 14, and a resist roller 15.

The sheet feeding tray 9 includes a sheet pressing plate 16 therein and a lever 17 in the front end portion thereof. The lever 17 lifts up the front end portion of the sheet pressing plate 16.

The sheets 3, which are placed on the sheet pressing plate 16, are transported to a separation position between the separation roller 10 and the separation pad 11 by the rotation of the sheet feeding roller 12 and separated one by one at the separation position, and then each sheet 3 passes a space between the sheet dust removing roller 13 and the pinch roller 14, and is transported toward the resist roller 15.

The sheet 3 transported to the resist roller 15 is then transported to a transfer position between a transfer roller 31 and a photosensitive drum 28 which will be described later and serves as an example of an image carrier.

(3) Image Forming Section

The image forming section 5 includes a scanning section 19, a process unit 20 and a fixing section 21.

(a) Scanning Section

The scanning section 19 is provided at an upper portion in the main body casing 2, and includes a laser beam source (not shown), a rotatably driven polygonal mirror 22, an fθ lens 23, a reflecting mirror 24, a lens 25 and a reflecting mirror 26. The laser beam source emits laser beams based upon image data. The beams are deflected at the polygonal mirror 22 and pass the fθ lens 23, as indicated by a chain line. The beam passage is then reflected by the reflecting mirror 24, the beams pass the lens 25, and further reflected downward by the reflecting mirror 26 to be irradiated on the surface of the photosensitive drum 28 in the process unit 20.

(b) Process Unit

Figure 2:
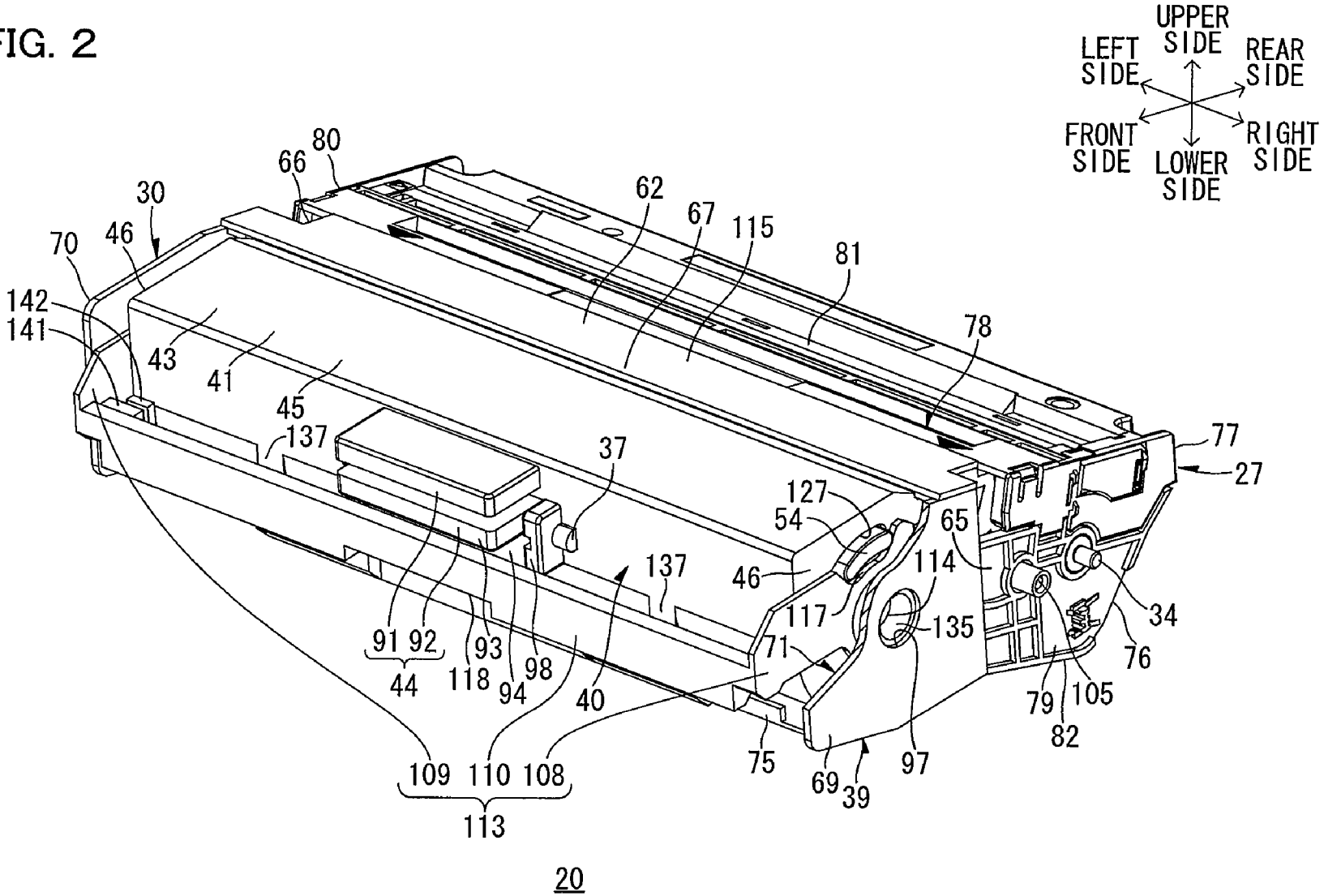
FIG. 2 is a right perspective view of a process unit in a laser printer shown in FIG. 1 as viewed from above the front side.
Figure 3:
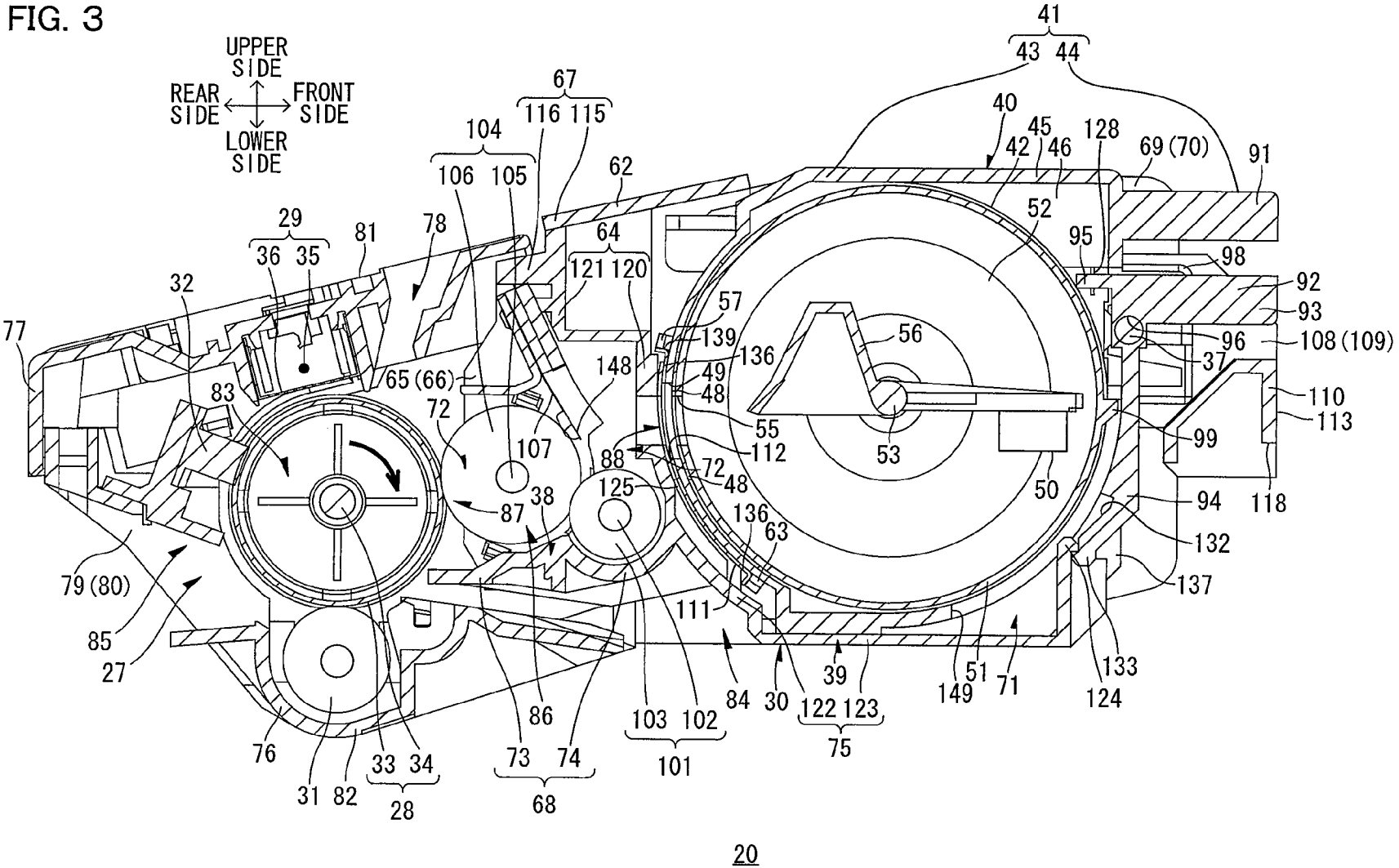
FIG. 3 is a left sectional side view of a process unit in FIG. 2.

FIG. 2 is a right perspective view of a process unit in the laser printer shown in FIG. 1 as viewed from above the front side, and FIG. 3 is a left sectional side view of the process unit in FIG. 2.

FIG. 4(*a*) shows an aspect in which a toner box is detached, an open/close lever is at a contacting position and a toner guiding port as an example of a second opening is opened in the FIG. 2, and FIG. 4(*b*) shows an aspect in which the open/close lever is at a release position and the toner guiding port is closed in the FIG. 4(*a*).

FIG. 5(*a*) is a left perspective view of a toner box in the process unit shown in FIG. 2 as viewed from above the rear side, and shows an aspect where a toner ejecting port is opened; FIG. 5(*b*) shows an aspect where the toner ejecting port is closed in FIG. 5(*a*); and FIG. 5(*c*) is a left perspective view of an inner casing in the toner box shown in FIG. 5(*a*) as viewed from above the rear side.

Figure 6:
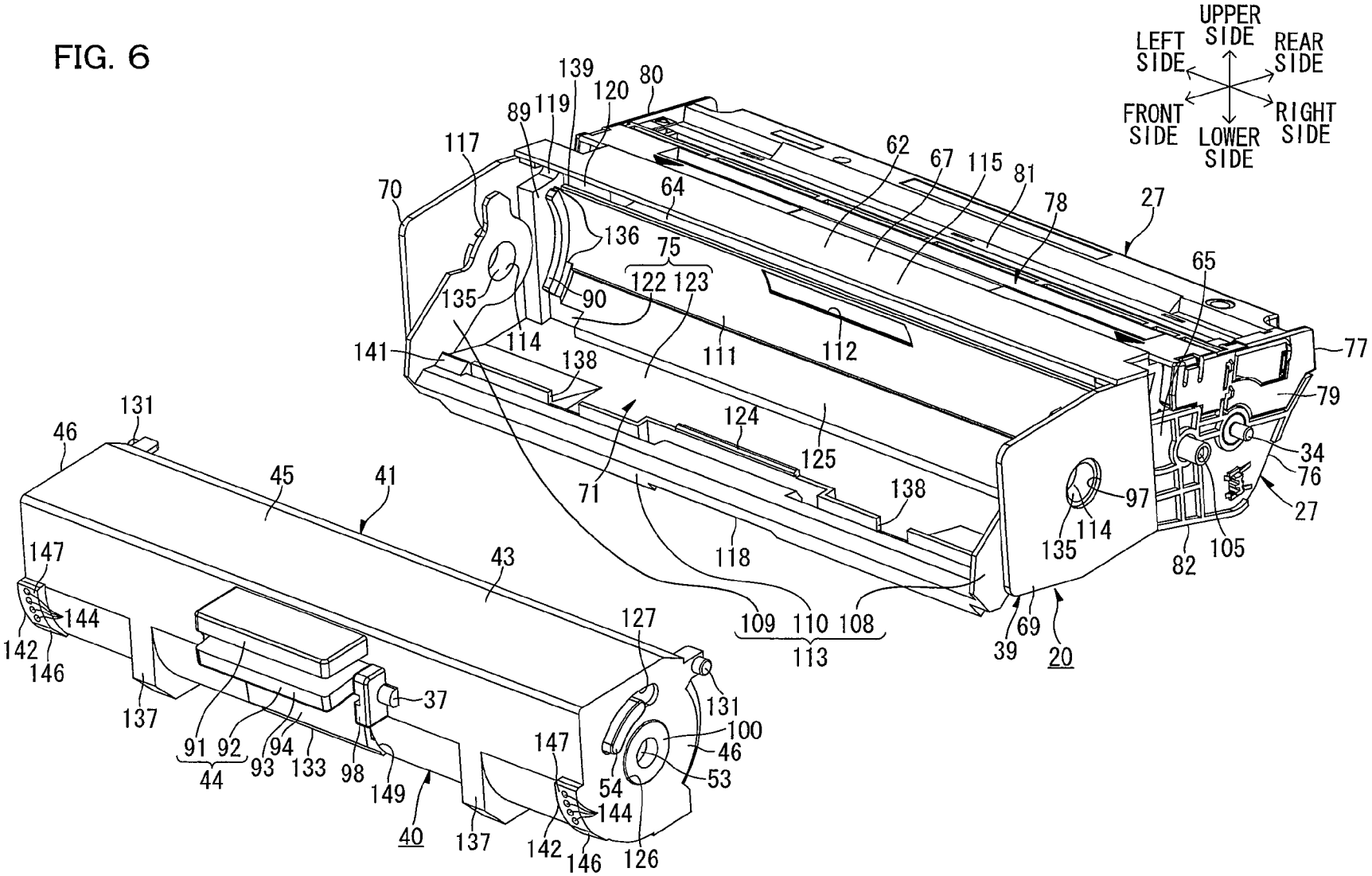
FIG. 6 shows an aspect where the toner box has been removed and the open/close lever is at the release position in FIG. 2, together with the toner box removed therefrom.
Figure 7:
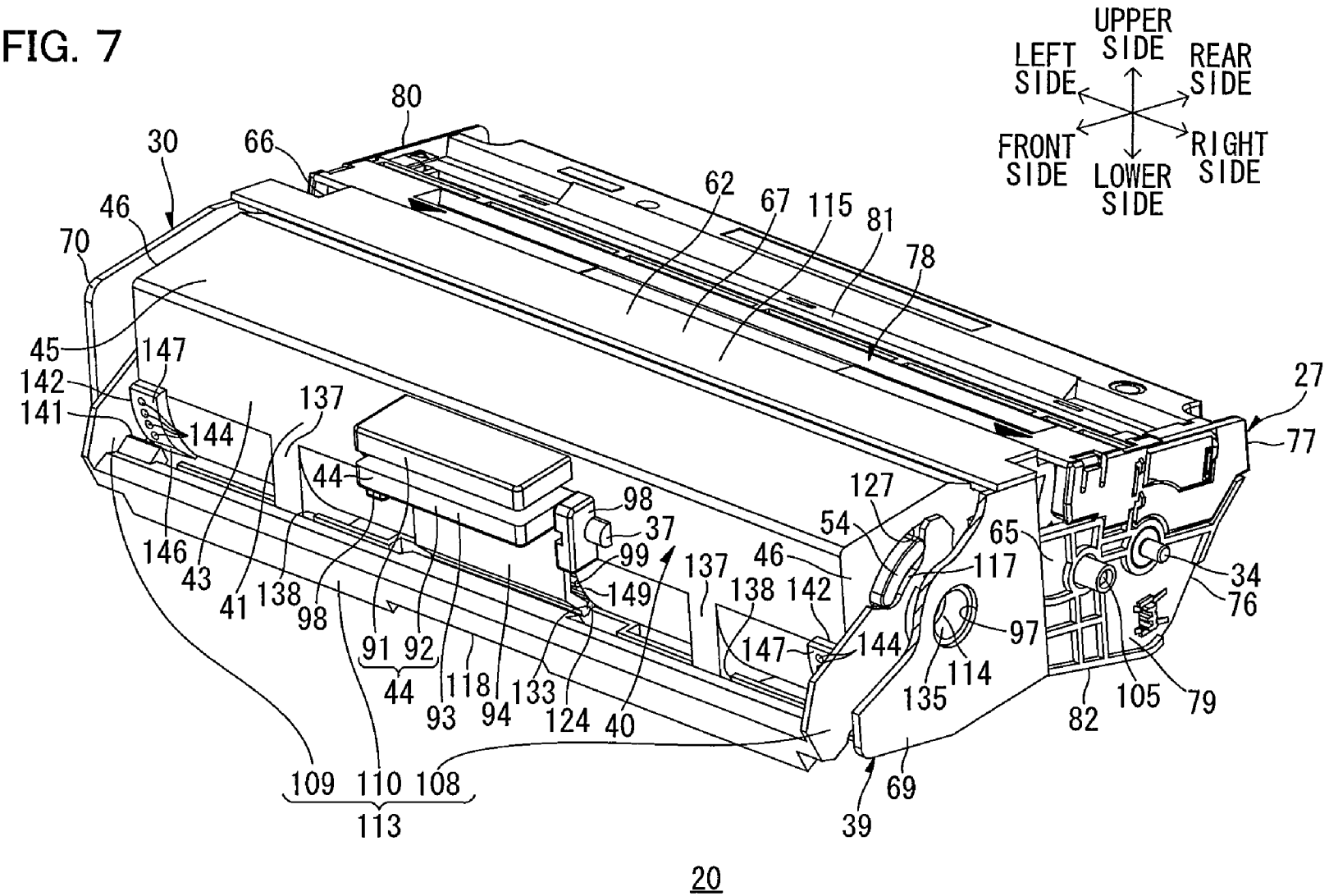
FIG. 7 shows an aspect where the open/close lever is at the release position in FIG. 2.

FIG. 6 shows an aspect in which the toner box is detached and the open/close lever is at the release position in FIG. 2, together with the toner box detached therefrom, while FIG. 7 shows an aspect in which the open/close lever is at the release position in FIG. 2.

Figure 8:
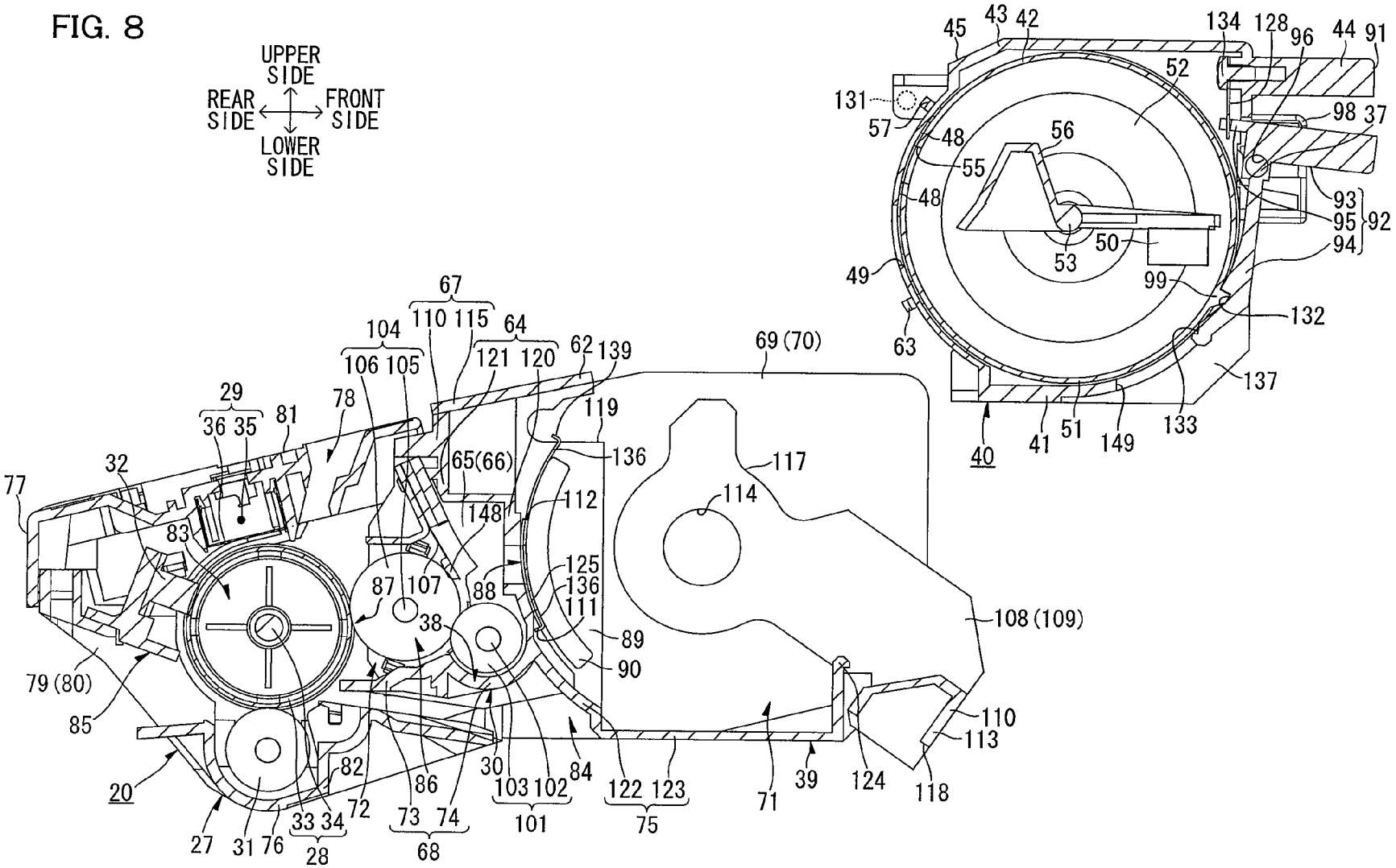
FIG. 8 is a left sectional side view of the process unit in FIG. 6.
Figure 9:
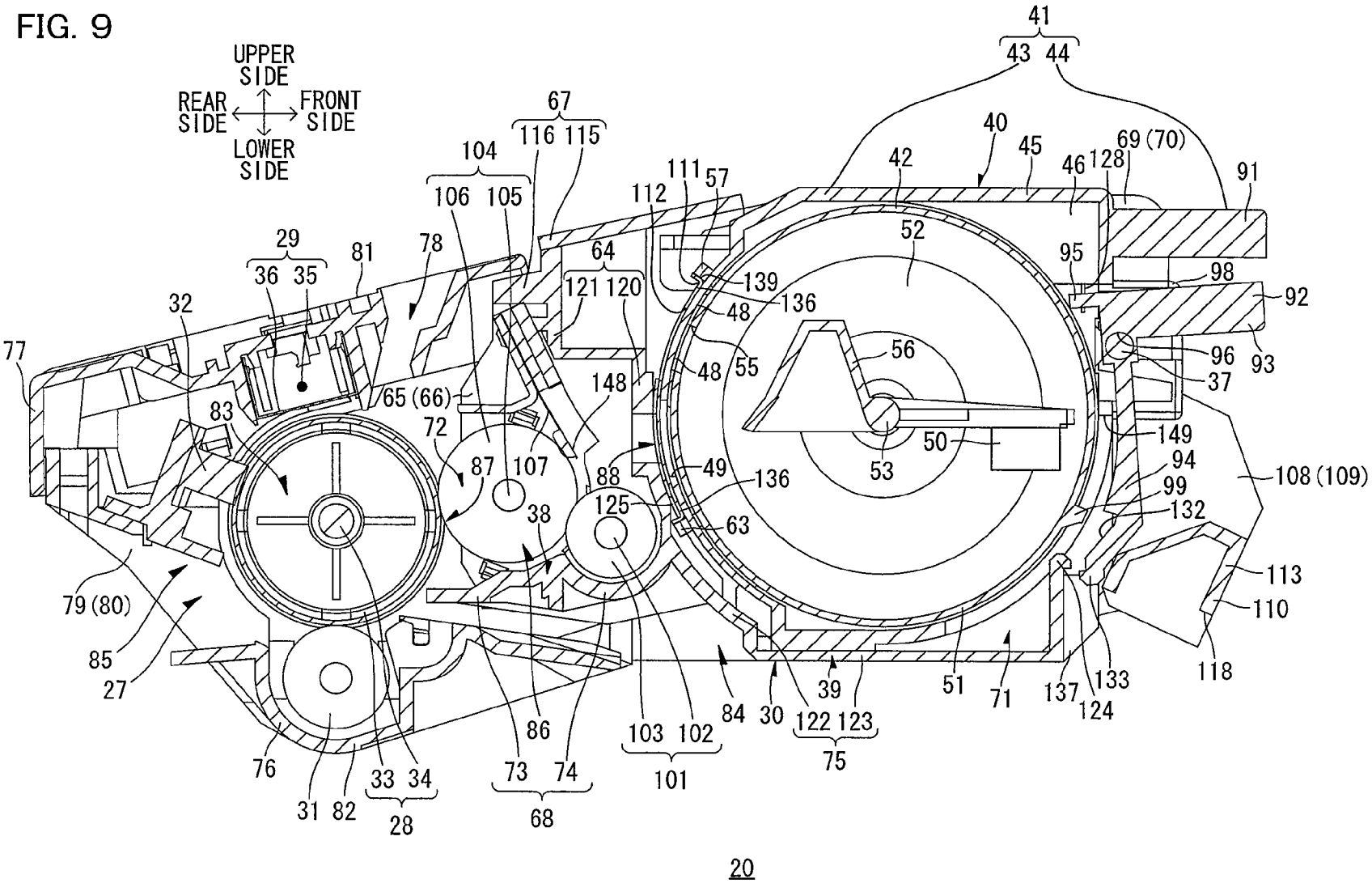
FIG. 9 is a left sectional side view of a process unit in FIG. 7, wherein a swinging member is in a second state.
Figure 10:
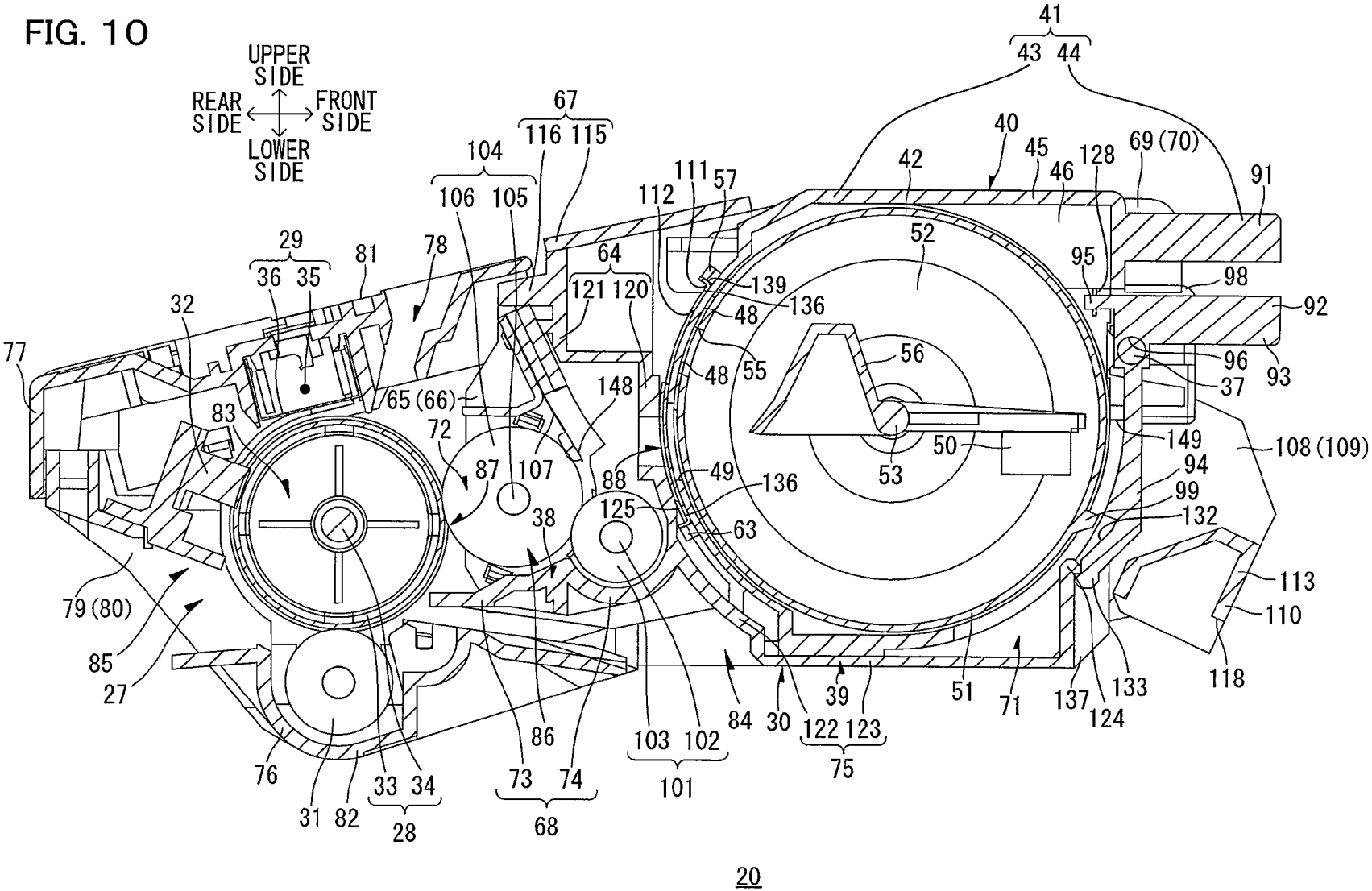
FIG. 10 is a left sectional side view of a process unit in FIG. 7, wherein the swinging member is in a third state.
Figure 11:
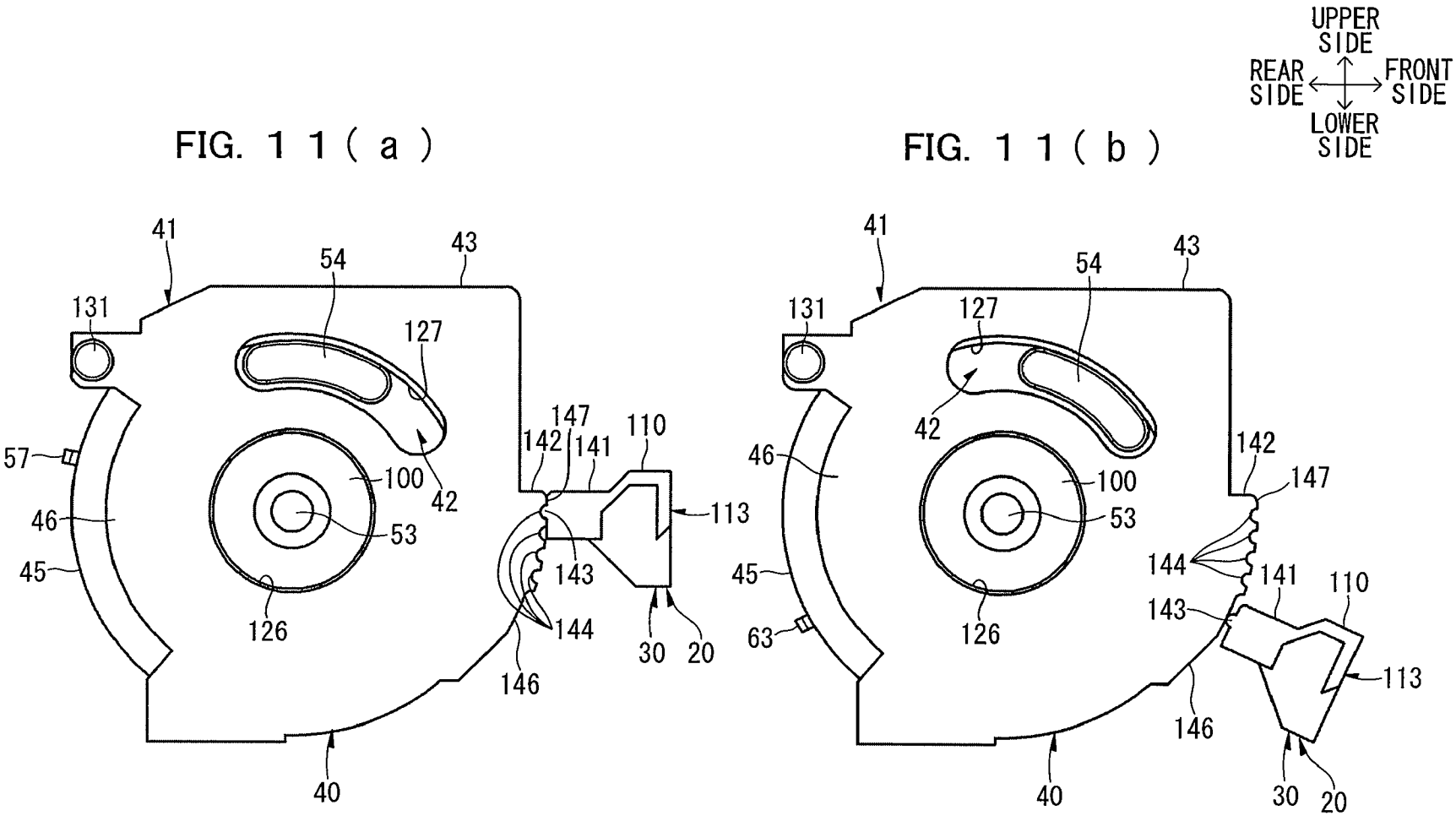
FIGS. 11(*a*) and 11(*b*) are left sectional side views of the process unit showing a contact portion of the toner box and an contacting portion of a process unit side grasp portion, wherein FIG. 11(*a*) illustrates an aspect in which the open/close lever is at the contacting position and FIG. 11(*a*) illustrates an aspect in which the open/close lever is at the release position.
Figures 12A, 12B:
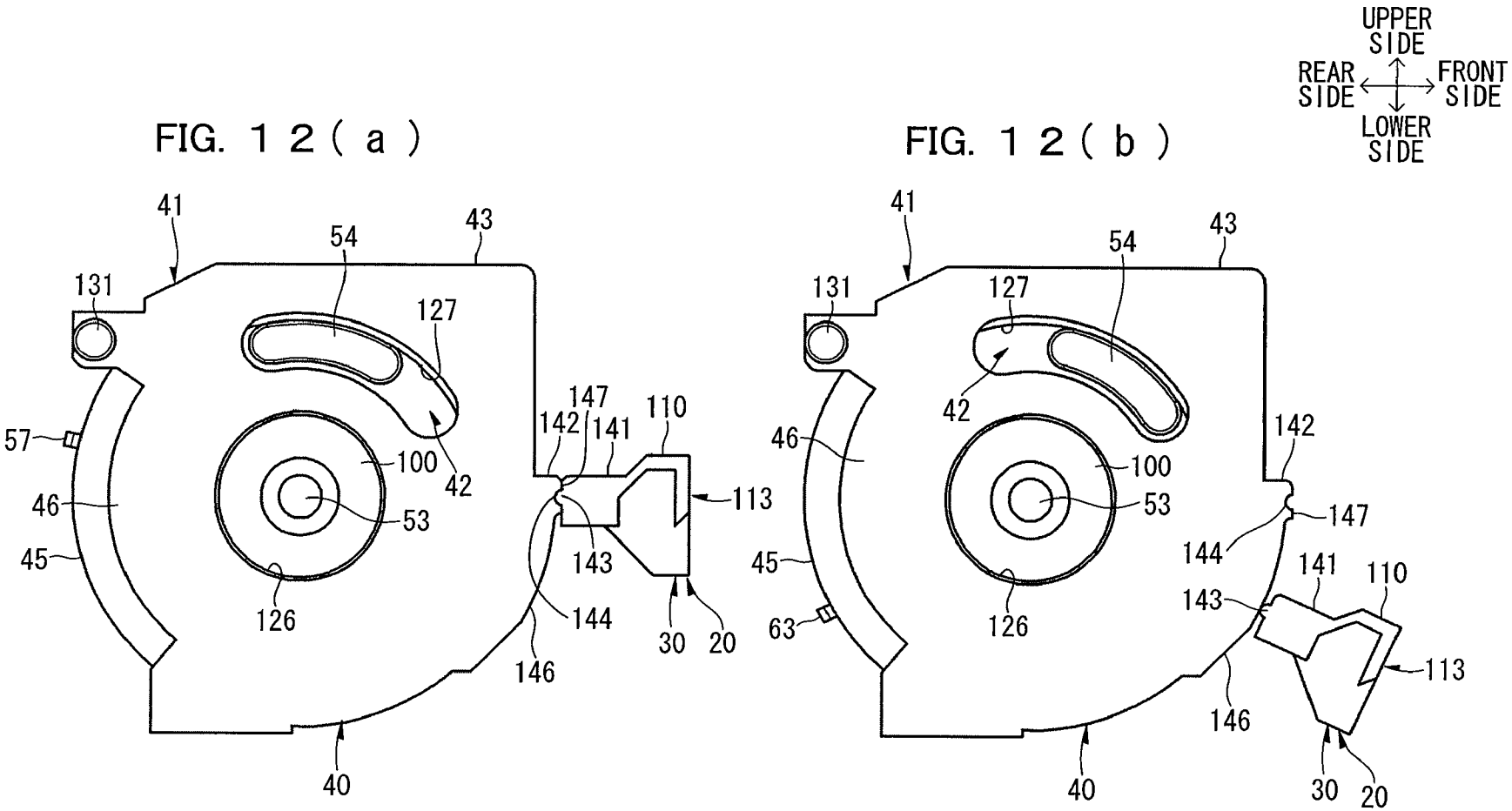
FIG. 12 shows a modification of a contact portion and the contacting portion in FIG. 11.

FIG. 8 is a left sectional side view of the process unit in FIG. 6, while FIG. 9 is a left sectional side view of a process unit in FIG. 7, wherein a swinging member is in a second state. FIG. 10 is a left sectional side view of a process unit in FIG. 7, wherein the swinging member is in a third state. FIGS. 11(*a*) and 11(*b*) are left sectional side views of the process unit showing a contact portion of the toner box and a contacting portion of a process unit side grasp portion, wherein FIG. 11(*a*) illustrates an aspect in which the open/close lever is at the contacting position and FIG. 11(*b*) illustrates an aspect in which the open/close lever is at the release position. FIG. 12 shows a modification of a contact portion and contacting portion in FIG. 11.

The process unit 20 is provided at a lower portion of the scanning section 19 in the main body casing 2 and is detachably mountable to the main body casing 2 via the mounting port 6, as shown in FIG. 1. The attaching and detaching directions of the process unit 20 to and from the main body casing 2 are an obliquely downwardly rearward direction (attaching direction) and an obliquely upwardly forward direction (detaching direction), respectively, as indicated by bold arrows in the drawing.

The process unit 20 integrally includes a drum section 27 which forms the rear half portion of the process unit 20, and a developing section 30 which forms the front half portion of the process unit 20 as an example of a unit main body, and further includes a toner box 40 which is detachably attached to the process unit 20, as shown in FIG. 3.

(b-1) Drum Section

The drum section 27 includes a drum casing 76, and includes the photosensitive drum 28, a scorotron charger 29, a transfer roller 31 and a cleaning blush 32 which are provided in the drum casing 76.

The drum casing 76 is in a box shape which is longitudinal in width direction, and whose front portion is opened, and integrally includes a drum rear wall 77, a drum right wall 79 (see FIG. 2), a drum left wall 80 (see FIG. 2), a drum top wall 81, and a drum bottom wall 82.

The drum right wall 79 and the drum left wall 80 are disposed in an opposed spaced relation with each other in the width direction as shown in FIG. 2.

The drum bottom wall 82 is extended between the lower end edges of the drum right wall 79 and the drum left wall 80. The drum top wall 81 is extended between the upper end edges of the drum right wall 79 and the drum left wall 80. The drum rear wall 77 is extended between the rear end edges of the drum right wall 79 and the drum left wall 80, as shown in FIG. 3.

Midway in an anteroposterior direction of the drum top wall 81, a laser entrance port 78 is formed for the irradiation of the laser beams from the scanning section 19 to the photosensitive drum 28. A first passing port 84 is opened between the front end edge of the drum bottom wall 82 and the rear end edge of a developer rear bottom wall 68 of the developing section 30 which will be described later. Midway in a vertical direction of the drum rear wall 77, a second passing port 85 is opened. Both of the first passing port 84 and the second passing port 85 are formed in a longitudinal rectangular shape in the width direction.

In this drum casing 76, the space defined by the drum rear wall 77, and, the rear half portions of the drum right wall 79, the drum left wall 80 and the drum bottom wall 82, and the drum top wall 81, forms a drum accommodation section 83 which accommodates the photosensitive drum 28, the scorotron charger 29, the transfer roller 31 and the cleaning blush 32. The drum accommodation section 83 is formed in a cylindrical shape whose front side and rear side are opened.

On the other hand, the space defined by the front half portions of the drum right wall 79, the drum left wall 80, and the drum bottom wall 82 forms a developer arrangement section 86 where the developing section 30 is arranged. The developer arrangement section 86 is formed as a bottomed frame in a flat-bottomed U-shape, as viewed in front cross section, whose upper side is opened.

The drum accommodation section 83 and the developer arrangement section 86 are communicating with each other.

The photosensitive drum 28 is in a cylindrical shape and includes a drum body 33 whose outermost layer is formed by a positively chargeable photosensitive layer formed of polycarbonate or the like, and a metal drum shaft 34 extending through the shaft center of the drum body 33 along an axial direction of the drum body 33. Both end portions of the drum shaft 34 in an axial direction are supported between the drum right wall 79 and the drum left wall 80 of the drum casing 76 (see FIG. 2). The drum body 33 is rotatably supported with respect to the drum shaft 34, and as a result, the photosensitive drum 28 is rotatable about the drum shaft 34 in the drum casing 76. A driving force from a motor (not shown) rotationally drives the photosensitive drum 28 in the direction of bold arrow in the drawing.

The scorotron charger 29 is supported on the drum top wall 81 of the drum casing 76 at the position obliquely rearward above the photosensitive drum 28 and disposed in opposed spaced relation with the photosensitive drum 28 so as not to contact to the photosensitive drum 28. This scorotron charger 29 includes a discharge wire 35 which is disposed in an opposed spaced relation with the photosensitive drum 28, and a grid 36 which is provided between the discharge wire 35 and the photosensitive drum 28 for controlling the amount of the charge from the discharge wire 35 to the photosensitive drum 28.

In this scorotron charger 29, a bias voltage is applied to the grid 36 and at the same time a high voltage is applied to the discharge wire 35 to generate corona discharge, thereby positively charging the surface of the photosensitive drum 28 uniformly.

The transfer roller 31 is provided below the photosensitive drum 28 in the drum casing 76, opposingly contacts with the photosensitive drum 28 in the vertical direction so as to form a nip between itself and the photosensitive drum 28, and the nip serves as the above described transfer position between the photosensitive drum 28 and the transfer roller 31.

In addition, the transfer roller 31 includes a metal roller shaft which is rotatably supported between the drum right wall 79 and the drum left wall 80 of the drum casing 76, and a rubber roller which is formed of a conductive rubber material and covers the roller shaft. The transfer roller 31 is applied with a transfer bias at the time of transfer. A driving force from a motor (not shown) rotationally drives the transfer roller 31.

The cleaning blush 32 is assembled onto the drum rear wall 77 of the drum casing 76 and disposed so as to opposingly contact with the photosensitive drum 28 at the position obliquely rearward above the photosensitive drum 28 and obliquely rearward below the scorotron charger 29.

(b-2) Developing Section

The developing section 30 is integrally formed with the drum section 27 in the developer arrangement section 86 of the drum casing 76.

This developing section 30 includes a developer casing 62 as an example of a second casing, a feed roller 101, and a developing roller 104 as an example of a developer carrier and a layer-thickness regulating blade 107 provided in the developer casing 62.

The developer casing 62 integrally includes a box-shaped rear-side casing 38 which is longitudinal in the width direction and whose rear side is opened, and a front-side casing 39 whose upper side and front side are opened and which has a width greater than the rear-side casing 38.

The rear-side casing 38 integrally includes a developer front wall 64, a developer right wall 65 (see FIG. 2), a developer left wall 66 (see FIG. 2), a developer top wall 67, and the developer rear bottom wall 68.

The developer right wall 65 and the developer left wall 66 are in a generally rectangular shape as viewed from side and disposed in an opposed spaced relation with each other in the width direction.

The developer rear bottom wall 68 is extended between the lower end edges of the developer right wall 65 and the developer left wall 66, and integrally includes a first bottom wall 73 and a second bottom wall 74 in this sequence from the rear in the anteroposterior direction.

The first bottom wall 73 is disposed on the rear side of the developer rear bottom wall 68, and formed in a tongue plate shape tilting downward from the front side toward the rear side.

The second bottom wall 74 is formed in generally semicircular shape as viewed in side section and extends continuously from the front end edge of the first bottom wall 73 along the feed roller 101.

The developer top wall 67 is extended between the upper end edges of the developer right wall 65 and the developer left wall 66 and integrally includes a first top wall 115 and a second top wall 116.

The first top wall 115 is disposed in front of the developer top wall 67 and extends toward the obliquely upwardly forward.

The second top wall 116 is formed in generally reversed L-shape as viewed in left side section which extends downward from the rear end edge of the first top wall 115 and then bents to extend backward.

The developer front wall 64 is extended between the front end edges of the developer right wall 65 and the developer left wall 66. The developer front wall 64 has an upper end edge connected to the above described bending portion of the second top wall 116 and a lower end edge connected to the front end edge of the second bottom wall 74, and integrally includes a longitudinal wall 120 which extends upward from the front end edge of the second bottom wall 74 and a bending wall 121 which is bent backward from the upper end edge of the longitudinal wall 120, then bent again and extends upward to be connected to the bending portion of the second top wall 116, and is formed in generally L-shape as viewed in left side section.

Rear end edges of the developer top wall 67, the developer left wall 65, the developer right wall 66 and the developer rear bottom wall 68 define an insertion hole 87 which is opened on the rear side of the rear-side casing 38. The insertion hole 87 is formed in a rectangular shape longitudinal in the width direction.

In the rear-side casing 38, the space defined by the developer front wall 64, the developer right wall 65, the developer left wall 66, the developer top wall 67, and the developer rear bottom wall 68 serves as a developing chamber 72 which accommodates the feed roller 101, the developing roller 104 and the layer-thickness regulating blade 107.

The front-side casing 39 is integrally formed with a right wall 69 as an example of a first wall (see FIG. 2), a left wall 70 as an example of a second wall (see FIG. 2), and a developer front bottom wall 75.

The developer front bottom wall 75 is formed in generally C-shape as viewed in side section and integrally includes a curved wall 122 which forms the rear half portion thereof and a L-shaped wall 123 which forms the front half portion thereof.

The curved wall 122 is formed in generally minor arc as viewed in side section and the front end edge thereof is connected to the rear end edge of the L-shaped wall 123.

The L-shaped wall 123 is formed in generally L-shape as viewed in side section which extends forward from the rear end edge thereof and is bent to extend upward. In the central portion in the width direction of the front end portion and the upper end portion of the L-shaped wall 123, an engagement portion 124 in a hook shape as viewed in side section which is bent at the upper end edge thereof and extends slightly forward, is integrally formed. As shown in FIG. 6, in the front end portion of the L-shaped wall 123, a positioning groove 138 which is concaved downward from the upper end edge of the front end portion of the L-shaped wall 123, is formed at each position spaced outwardly from the center of the width direction by a distance equivalent to approximately the one-quarter of the width size of the L-shaped wall 123.

The right wall 69 and the left wall 70 are disposed in opposed relation with each other in the width direction so as to sandwich the developer front bottom wall 75 therebetween and are formed in generally rectangular shape as viewed from side, as shown in FIG. 2. The obliquely upper front portion of the right wall 69 is cut out for ease of description in FIG. 2.

In the right wall 69 and the left wall 70, first insertion holes 97 which extend through the right wall 69 and the left wall 70 in the width direction are formed, respectively, at generally central positions thereof in the front-and-rear and up-and-down directions. The right wall 69 and the left wall 70 integrally include square columns 89 in the respective rear end portions of the laterally inner surfaces thereof, as shown in FIG. 4(*a*).

The square column 89 is formed in generally rectangular parallelepiped shape which is longitudinal in the vertical direction, and a guide groove 119 is formed in the upper end portion with the front end surface thereof being concaved toward the rear side. The square column 89 integrally includes a rib 90 on the laterally internal surface thereof below the guide groove 119. The rib 90 is formed to extend toward the laterally inner side so that the side section thereof forms generally a minor arc, and disposed so as to curve generally along the curved wall 122 of the developer front bottom wall 75 and to be in slightly spaced relation in the radial direction with respect to the curved wall 122, as shown in FIG. 8.

In this front-side casing 39, the portion defined by the right wall 69, the left wall 70, and the developer front bottom wall 75 forms a toner box accommodation chamber 71 as an example of an accommodation section which accommodates the toner box 40. The toner box accommodation chamber 71 is formed in a bottomed frame with the upper side and the front side thereof being opened. In the toner box accommodation chamber 71, the right wall 69 is located at the right end of the toner box 40 that is accommodated and the left wall 70 is located at the left end of the toner box 40 that is accommodated.

The rear-side casing 38 and the front-side casing 39 are connected through the front side surface of the longitudinal wall 120 of the developer front wall 64 and the rear side surface of the curved wall 122 of the developer front bottom wall 75. A toner guiding port 88, which extends through the longitudinal wall 120 and the curved wall 122 in the thickness direction and serves as an example of a second opening, is formed at the laterally central position of the connecting portion of the longitudinal wall 120 and the curved wall 122.

The toner guiding port 88 is in a rectangular shape longitudinal in the width direction, and the toner guiding port 88 communicates the toner box accommodation chamber 71 and the developing chamber 72.

The toner box accommodation chamber 71 includes a shutter 111 as an example of a second blocking member and a open/close lever 113 as an example of a pivoting member.

The shutter 111 is a thin plate formed as a minor arc having a circumference slightly shorter than the curved wall 122 as viewed in section, as shown in FIG. 3. A penetration hole 112, which is in a rectangular shape as viewed from front and extends through the shutter 111 in the thickness direction as shown in FIG. 4(*b*), is formed at the laterally central position of the upper half portion thereof. In each of the upper end portions and the lower end portions of both lateral end portions of the shutter 111, a notched portion 136 which is cut out in generally L-shape as viewed from front, is formed. In the upper end portions of the shutter 111 laterally inward from the respective notched portions 136, engagement portions 139 are provided respectively. The engagement portions 139 are engaged by respective second radial projections 57 of the toner box 40 when the toner box 40 is in the attached state in the process unit 20.

In the toner box accommodation chamber 71, the both lateral end portions of the shutter 111 are interposed between the curved wall 122 and the rib 90 of the square column 89, and thus the shutter 111 is pivotably supported along the side-sectional shape of the rib 90, as shown in FIG. 8

The shutter 111 can move between a developer closing position (see FIG. 8) which closes the toner guiding port 88 at a portion where the penetration hole 112 is not formed, and a developer opening position (see FIG. 3) where the penetration hole 112 and the toner guiding port 88 are disposed in opposed relation to allow the toner guiding port 88 to be released forward.

A seal member 125 is interposed between the curved wall 122 and the shutter 111. The seal member 125 is formed in a sheet shape, for example, of felt and the like and attached on the front side surface of the curved wall 122 so as not to block the toner guiding port 88.

The open/close lever 113 is formed in generally U-shape as viewed from top as shown in FIG. 4(*a*) and integrally includes a right support portion 108 as an example of a first arm, a left support portion 109 as an example of a second arm, and a process unit side grasp portion 110 as an example of a contacting member.

The right support portion 108 and the left support portion 109 are formed in generally P-shaped thin plate as viewed from right side. In generally central position of the rear half portions of the right support portion 108 and the left support portion 109, round holes 114 are formed respectively and penetrate the right support portion 108 and the left support portion 109 in the thickness direction.

In each of the laterally outside surface of the right support portion 108 and the left support portion 109, a support cylinder 135 is provided in a position corresponding to the round hole 114. The support cylinder 135 has an inner diameter identical to the diameter of the round hole 114 and extends outwardly in the width direction. The support cylinder 135 has an outer diameter slightly smaller than the inner diameters of the first insertion holes 97 of the right wall 69 and the left wall 70 described above.

In the upper portion of the round holes 114 in the right support portion 108 and the left support portion 109, receiving portions 117 are formed respectively. Each of the receiving portions 117 has an upper end edge recessed toward the round hole 114 in generally U-shape as viewed from side.

The process unit side grasp portion 110 is formed in generally-rectangular-shaped widthwise-elongated thin plate as viewed from front and extended between the front end portions (free ends) of the right support portion 108 and the left support portion 109. The process unit side grasp portion 110 has a grip portion 118 as an example of a first grasp portion, whose lower end edge recesses upward at the laterally central position thereof. In the process unit side grasp portion 110, on both lateral end portions on the side surfaces of the round hole 114 side, the contacting projections 141 which are in generally rectangular parallelepiped shape and serve as examples of first parts protruding toward the round hole 114 are provided respectively. As shown in FIGS. 11 and 12, the side surface (rear side surface) of the contacting projection 141 on the side of the round hole 114 is provided with a contacting portion 143 (as an example of a first portion) which is formed in a convex shape toward the side of the round hole 114 (rear side). Specifically, the contacting portion 143 is formed in a hemisphere shape.

As shown in FIG. 4(*a*), the respective support cylinders 135 of the right support portion 108 and the left support portion 109 are fitted into the first insertion holes 97 of the right wall 69 and the left wall 70, so that the open/close lever 113 is pivotably supported on the right wall 69 and the left wall 70. In this state, as is the case with the open/close lever 113, the right support portion 108 and the left support portion 109 which are pivotably supported on the corresponding right wall 69 and left wall 70, extend to the downstream side of the detaching direction of the toner box 40 described above, or specifically, extend to the front side. The open/close lever 113 is allowed to pivot between a release position (see FIG. 4(*b*)) in which the process unit side grasp portion 110 of the open/close lever 113 is positioned below the round hole 114, and a contacting position (see FIG. 4 (*a*)) in which the process unit side grasp portion 110 is arranged at the position identical to the round hole 114 in the vertical direction. The release position (see FIG. 11(*b*)) is located below the contacting position (see FIG. 11(*a*)). Further, in the state shown in FIG. 4(*b*), that is, the state where the toner box 40 is not attached in the developing section 30, the open/close lever 113 is at the release position by its own weight.

The grip portion 118 is consistently exposed outward from the toner box accommodation chamber 71 as viewed from side irrespective of the position of the open/close lever 113, as shown in FIG. 3.

In the developing chamber 72 of the rear-side casing 38, the feed roller 101, the developing roller 104, and the layer-thickness regulating blade 107 are accommodated, as described above.

The feed roller 101 is disposed at obliquely rear side below the toner guiding port 88. The feed roller 101 includes a metal feed roller shaft 102, and a sponge roller 103 which is formed of a conductive foamed material and covers the feed roller shaft 102. Both axial end portions of the feed roller shaft 102 are rotatably supported on the developer right wall 65 and the developer left wall 66 at the positions corresponding to the second bottom wall 74 in the anteroposterior direction. A driving force from a motor (not shown) is input to the feed roller shaft 102 to rotationally drive the feed roller 101.

The developing roller 104 is disposed on the rear side of the feed roller 101 so as to be in contact with the feed roller 101 compressingly to each other. The developing roller 104 is longitudinal in the width direction and includes a metal developing roller shaft 105, and a rubber roller 106 which is formed of a conductive rubber material and covers the developing roller shaft 105.

Both axial end portions of the developing roller shaft 105 are rotatably supported on the developer right wall 65 and the developer left wall 66 at the positions corresponding to the first bottom wall 73 in the anteroposterior direction. The rubber roller 106 is formed of a conductive polyurethane rubber or a silicone rubber containing fine carbon particles and the like and the surface thereof is covered with a resin coating layer excellent in abrasion resistance such as polyurethane rubber or polyimide containing fluorine. A driving force from a motor (not shown) is input to the developing roller shaft 105 to rotationally drive the developing roller 104. The developing roller 104 is applied with developing bias during developing process via one lateral end portion of the developing roller shaft 105 exposed from the developer right wall 65, as shown in FIG. 2.

The layer-thickness regulating blade 107 is formed of a metal blade spring material and the free end thereof includes a pressing member 148 which is in a generally semicircular shape as viewed in section and formed of electrically insulative or conductive silicone rubber or polyurethane rubber, as shown in FIG. 3. In the layer-thickness regulating blade 107, the proximal edge thereof is supported on the second top wall 116 of the developer top wall 67 above the developing roller 104, whereby the pressing member 148 thereof is in press contact to the developing roller 104 by the elastic force of the layer-thickness regulating blade 107.

In the drum section 27 and the developing section 30, the front end portion of the drum top wall 81 of the drum section 27 is fitted to the above described bending portion of the second top wall 116 of the developing section 30, and, the respective rear end edges of the developer right wall 65 and the developer left wall 66 of the developing section 30 are brought into contact with the front end edges of the drum right wall 79 and the drum left wall 80 respectively, as shown in FIG. 2. Thus, the developing section 30 is assembled to the drum section 27. In a state where the developing section 30 is assembled with the drum portion 27, the first passing port 84 described above is formed between the developer rear bottom wall 68 and the drum bottom wall 82, as shown in FIG. 3.

(b-3) Toner Box

The toner box 40 is detachably attached to the toner box accommodation chamber 71 of the developing section 30, as described above. The toner box 40 can be attached to and detached from the main body casing 2 by attaching and detaching the process unit 20 to and from the main body casing 2 via the mounting port 6 while the toner box 40 is in the attached state in the process unit 20. The attaching and detaching directions of the toner box 40 to and from the toner box accommodation chamber 71 of the process unit 20 are identical to the attaching and detaching directions of the process unit 20 to and from the main body casing 2, that is, the obliquely downwardly rearward direction (attaching direction) and the obliquely upwardly forward direction (detaching direction), respectively. The direction orthogonal to the attaching and detaching directions of the toner box 40 to and from the toner box accommodation chamber 71 is the width direction.

Since the toner box accommodation chamber 71 is positioned in front of the process unit 20, when the front cover 7 is opened and the mounting port 6 is released, the toner box 40 is exposed from the mounting port 6, as shown in FIG. 1.

The toner box 40 is in generally σ shape and longitudinal in the width direction as viewed in left side section as shown in FIG. 3, and includes an outer casing 41 and an inner casing 42 as an example of a first casing, which are formed of resin and the like.

(b-3-i) Outer Casing

The outer casing 41 is in generally σ shape as viewed in section from the left side same as the toner box 40, and integrally includes a cylinder 43 and a guide lever 44.

As shown in FIG. 5(*a*), the cylinder 43 is formed as a hollow cylinder which is generally in a rectangular shape as viewed from side and longitudinal in the width direction, and includes an outer round wall 45 as an example of a first blocking member, and a pair of outer side edge walls 46 which serve as both side end surfaces of the outer round wall 45 in the width direction.

In the central position of the rear side surface of the outer round wall 45 in the right-and-left and up-and-down directions, a first toner ejecting port 49 is formed which extends through the outer round wall 45 in the thickness direction. The first toner ejecting port 49 is formed in a rectangular shape longitudinal in the width direction.

In both lateral end portions of the rear side surface of the outer round wall 45, upper guide grooves 129 are formed respectively which extend through the outer round wall 45 in the thickness direction at the positions above the first toner ejecting port 49 and lower guide grooves 130 are formed respectively which extend through the outer round wall 45 in the thickness direction at the positions below the first toner ejecting port 49. Each of the upper guide grooves 129 and the lower guide grooves 130 is in a rectangular shape as view from the rear and longitudinal in the circumferential direction, the circumferential length thereof is set approximately twice as long as that of the first toner ejecting port 49, and the width length thereof is set approximately one-half of circumferential length of the first toner ejecting port 49.

In the lower portion of the front side surface of the outer round wall 45, positioning ribs 137 are provided respectively as examples of positioning portions at positions which are spaced away by a distance equivalent to the one-quarter of the width size of the outer round wall 45 outwardly in the width direction from the center thereof, as shown in FIG. 6. Each of the positioning ribs 137 is provided between the later described contact member 142 and the guide lever 44 in the width direction. The positioning rib 137 extends downwardly from the upper half portion of the front side surface of the outer round wall 45 in a continuous manner, and is bent to extend obliquely downwardly rearward, then is bent once again to extend rearward to continue to the rear half portion of the lower side surface of the outer round wall 45, and is thus formed in a generally isosceles trapezoid shaped thin plate as viewed from side. The positioning rib 137 has a width size slightly narrower than the groove width of the positioning groove 138 described above.

A projection exposing hole 149 is formed at a portion which is sandwiched in the width direction by the positioning ribs 137 on the lower part of the front side surface of the outer round wall 45. The projection exposing hole 149 is formed in rectangular shape and extends through the outer round wall 45 in the thickness direction.

On both lateral end portions of the lower part of the front side surface of the outer round wall 45, the contact member 142 is provided as an example of a second part. The contact member 142 is formed in generally arc shape as viewed from left side and protrudes forward from the front side surface of the outer round wall 45, and the size in the width direction is almost equal to that of the contacting projection 141 of the open/close lever 113 described above. The front side surface of the contact member 142 includes a guide surface 146 and a contact surface 147 as shown in FIG. 11. The guide surface 146 is formed so as to extend obliquely upwardly forward in a flat manner as viewed from left side, and then in the midway, convexly curves toward the front side. The contact surface 147 is formed so as to continue from the upper end edge of the guide surface 146, and protrudes forward farther than the convexly curved portion of the guide surface 146. On the contact surface 147, a plurality of contact portions 144 (as an example of second portion) which are formed as recesses toward the rearward are provided along the circumferential direction (up-and-down direction). Specifically, the contact portion 144 is formed so as to recess in a hemisphere shape. Although in FIG. 11, the plurality of contact portions 144 are provided, only one contact portion may be provided as shown in FIG. 12.

At a generally central position of each of the outer side edge walls 46 in anteroposterior and up-and-down directions, a second insertion hole 126 is formed which extends through each of the outer side edge walls 46 in the width direction, as shown in FIG. 5(*a*). Further, in each of the outer side edge walls 46, an insertion groove 127 is formed which extends through each of the outer side edge walls 46 in the width direction, and which is a minor arc concentric to the second insertion hole 126 at a radially outside position of the second insertion hole 126, specifically, in a range from 12 o'clock position to 2 o'clock position as viewed from left side.

Further, each of the outer side edge walls 46 is integrally formed with a positioning projection 131 which extends backward at a position corresponding to the upper end edge of the upper guide groove 129 and is bent to protrude outwardly in the width direction. The portion of the positioning projection 131 which protrudes outwardly in the width direction is formed in a column shape having an outer diameter smaller than the groove width of the guide groove 119 (see FIG. 4(*a*)) of the front-side casing 39 of the process unit 20 described above.

The guide lever 44 is disposed between the right and left contact member 142, more specifically, at the upper end portion of the front side surface and the laterally central position of the outer round wall 45, and includes a toner box side grasp portion 91 as an example of a second grasp portion, and a swinging member 92 as shown in FIG. 6.

The toner box side grasp portion 91 is formed in generally rectangular shape as viewed from top and is longitudinal in the width direction, and the rear end portion thereof is fixed to the outer round wall 45, as shown in FIG. 8.

The swinging member 92 is formed in generally rectangular shape as viewed from top and generally T-shape as viewed in side section, and includes integrally a grip portion 93, a first restricting portion 94, and a second restricting portion 95.

The grip portion 93 and the second restricting portion 95 are formed in generally rectangular shape as viewed from top.

The first restricting portion 94 is formed in rectangular shape as viewed from front and generally J-shape as viewed from left in section. The lower end portion thereof includes a first engaging portion 132 and a second engaging portion 133 in this order from the top. The first engaging portion 132 is formed as a groove extending in the width direction so that the rear side surface of the lower end portion of the first restricting portion 94 recesses forward. The second engaging portion 133 is formed in generally hook shape as viewed from left in section in which the lowest end portion of the first restricting portion 94 slightly bends rearward below the first engaging portion 132.

Furthermore, the rear end portion of the grip portion 93, the upper end portion of the first restricting portion 94, and the front end portion of the second restricting portion 95 are connected with one another. In the connecting position between the rear end portion of the grip portion 93 and the upper end portion of the first restricting portion 94, a shaft insertion hole 96 is formed to extend through the grip portion 93 and the first restricting portion 94 in the width direction.

On the front side surface of the outer round wall 45, a pair of shaft support portions 98 are integrally formed so as to protrude forward and laterally sandwich the grip portion 93 of the swinging member 92 therebetween. An insertion shaft 37 extended between the pair of shaft support portions 98 is inserted through the shaft insertion hole 96 of the swinging member 92, so that the swinging member 92 is swingably supported on the outer round wall 45.

Further, the rear end portion of the toner box side grasp portion 91 and the second restricting portion 95 of the swinging member 92 are connected by an elastic member 128. Specifically, the elastic member 128 is, for example, a blade spring, and the one end portion thereof is threaded to the rear end portion of the toner box side grasp portion 91 with a screw 134, and the other end portion is engaged with the second restricting portion 95. Thus, the swinging member 92 is continuously urged in a clockwise direction about the insertion shaft 37 so that the second restricting portion 95 comes close to the toner box side grasp portion 91 by an urging force of the elastic member 128.

(b-3-ii) Inner Casing

The inner casing 42 is longitudinal in the width direction, is formed in a hollow column having a size smaller than the cylinder 43 of the outer casing 41, and integrally includes a cylindrical inner round wall 51 and a pair of flat disc-like inner side edge walls 52 for blocking both lateral side surfaces of the inner round wall 51, as shown in FIG. 5(*c*). Between the centers of the circles of the respective inner side edge walls 52 which oppose to each other in the width direction, an agitator rotating shaft 53 is extended, as shown in FIG. 3. The agitator rotating shaft 53 is rotatably supported on the inner side edge walls 52, and is provided with an agitator 56. The agitator 56 is provided with wipers 50. The wipers 50 are formed of, for example, a rubber and mounted to both axial (lateral) end portions of the agitator rotating shafts 53.

The both lateral end portions of the agitator rotating shaft 53 protrude outward in the width direction from the respective inner side edge walls 52, as shown in FIG. 5(*c*). A collar 100 is fit onto each of the protruding portions of the agitator rotating shaft 53. The collar 100 has an outer diameter slightly smaller than the hole diameter of the second insertion hole 126 (see FIG. 5(*a*)) of the outer casing 41.

On the inner side edge walls 52, lateral projections 54 are respectively provided as examples of first engaging portions protruding outwardly in the width direction at positions which are radially outward from the agitator rotating shaft 53 and at which the lateral projections 54 are opposed to each other in the width direction. Each of the lateral projections 54 is formed in generally minor arc shape as viewed from side and the circumferential length thereof is approximately one-half of that of the insertion groove 127 of the outer casing 41 (described above), and the radial length thereof is slightly smaller than the groove width of the insertion groove 127.

Moreover, at one portion on a circumference in the lateral center of the inner round wall 51, specifically, at a position shifted by approximately 90° in a counterclockwise direction with respect to the lateral projection 54 as viewed from the left side, a second toner ejecting port 55 is formed and serves as an example of a first opening, extending through the inner round wall 51 in the thickness direction. The second toner ejecting port 55 is formed in a rectangular shape with a size generally identical to that of the first toner ejecting port 49 of the outer casing 41 as viewed from the radial outside.

On the inner round wall 51, a first radial projection 48 is provided along a circumferential edge of the second toner ejecting port 55 and protrudes outward in the radial direction. The first radial projection 48 is formed in a shape of a rectangular frame as viewed from the radial outside, and formed of elastic materials such as rubber or a sponge sheet.

On both lateral end portions of the inner round wall 51, respectively, the second radial projections 57 as examples of second engaging portions are integrally provided at positions slightly above the upper end edge of the first radial projection 48 and protrude outward in the radial direction. Further, on the both lateral end portions of the inner round wall 51, respectively, third radial projections 63 as examples of second engaging portions are integrally provided at positions below the lower end edge of the first radial projection 48 and protrude outward in the radial direction. The second radial projection 57 and the third radial projection 63 are formed to have an identical size. The lateral lengths thereof are designed to be smaller than the groove widths of the upper guide groove 129 and the lower guide groove 130 of the outer casing 41.

Further, on the inner round wall 51, a fourth radial projection 99 is formed at a position opposite to the second toner ejecting port 55 in relation to the shaft center of the inner casing 42, and protrudes outward in the radial direction and extends along the width direction, as shown in FIG. 3. The size in the width direction of the fourth radial projection 99 is set smaller than the size in the width direction of the projection exposing hole 149 of the outer casing 41.

(b-3-iii) Assembling of Inner Casing into Outer Casing

In the toner box 40 described above, the inner casing 42 is accommodated in the outer casing 41, and both lateral end portions of the agitator rotating shafts 53 of the inner casing 42 are engaged respectively into the second insertion holes 126 of the outer casing 41 together with the collars 100 described above, as shown in FIG. 5 (*a*). Thereafter, each of the lateral projections 54 of the inner casing 42 is protruded outward in the width direction from each of the insertion grooves 127 of the outer casing 41, each of the second radial projections 57 of the inner casing 42 is protruded outward in the radial direction of the inner casing 42 from each of the upper guide grooves 129 of the outer casing 41, and each of the third radial projections 63 of the inner casing 42 is protruded outward in the radial direction of the inner casing 42 from each of the lower guide grooves 130 of the outer casing 41. Further, the fourth radial projection 99 of the inner casing 42 is exposed inside the projection exposing hole 149 of the outer casing 41 (see FIG. 8).

Accordingly, the inner casing 42 is assembled into the outer casing 41, and the inner casing 42 is pivotably supported on both of the outer side edge walls 46 of the outer casing 41. As a result, each of the lateral projections 54 is allowed to slide along the corresponding insertion groove 127, each of the second radial projections 57 is allowed to slide along the corresponding upper guide groove 129, and each of the third radial projections 63 is allowed to slide along the corresponding lower guide groove 130. The lateral projections 54, the second radial projections 57, and the third radial projections 63 can pivot together with the second toner ejecting port 55 in relation to the outer round wall 45.

When the toner box 40 thus assembled is in a state not being attached to the process unit 20 as shown in FIG. 8, the first engaging portion 132 in the first restricting portion 94 of the outer casing 41 engages with the fourth radial projection 99 of the inner casing 42, and the pivot of the inner casing 42 with respect to the outer casing 41 is restricted. This state of the swinging member 92 will hereinafter be referred to as a first state.

In the first state as described above, when the toner box side grasp portion 91 and the swinging member 92 are held together, the swinging member 92 swings in a counterclockwise direction about the insertion shaft 37 against the urging force of the elastic member 128. After the toner box side grasp portion 91 and the swinging member 92 are held together for a while, the swinging of the swinging member 92 stops. This state of the swinging member 92 will hereinafter be referred to as a second state.

In the second state, as shown in FIG. 9, the first engaging portion 132 of the afore-described first restricting portion 94 is apart from the fourth radial projection 99 of the inner casing 42, and the engagement of the first engaging portion 132 with the fourth radial projection 99 is released. However, the rear end portion of the second restricting portion 95 is brought into contact with the inner round wall 51 of the inner casing 42, so that the pivot of the inner casing 42 with respect to the outer casing 41 is restricted.

Therefore, when the swinging member 92 is in a third state which is between the first state and the second state, the engagement between the first engaging portion 132 and the fourth radial projection 99 is released and additionally, the rear end portion of the second restricting portion 95 is not brought into contact with the inner round wall 51 of the inner casing 42, the restriction against the pivot of the inner casing 42 with respect to the outer casing 41 is released, as shown in FIGS. 3 and 10. In this case, when the inner casing 42 is pivoted with respect to the outer casing 41, each of the lateral projections 54 is guided to the corresponding insertion groove 127, each of the second radial projections 57 is guided to the corresponding upper guide groove 129, and each of the third radial projections 63 is guided to the corresponding lower guide grooves 130, as shown in FIG. 5(*b*). At the time of pivot of the inner casing 42 with respect to the outer casing 41, the first radial projection 48 of the inner casing 42 is in sliding contact with the internal side surface of the outer round wall 45 of the outer casing 41, whereby the outer casing 41 and the inner casing 42 are kept in air-tight and fluid-tight manner, as shown in FIG. 3.

Moreover, as shown in FIGS. 5(*b*) and 8, when the swinging member 92 is in the third state, the inner casing 42 can pivot to a toner closing position where the second toner ejecting port 55 of the inner round wall 51 is blocked by a portion of the outer round wall 45 of the outer casing 41 other than the first toner ejecting port 49 and the internal portions of the outer casing 41 and the inner casing 42 are sealed. At this time, each of the second radial projections 57 contacts with the upper end edge of the corresponding upper guide groove 129, each of the third radial projections 63 contacts with the upper end edge of the corresponding lower guide groove 130, and each of the lateral projections 54 contacts with the front end edge of the corresponding insertion groove 127. On the other hand, the inner casing 42 can pivot to a toner opening position where the internal portions of the outer casing 41 and the inner casing 42 are released by bringing the first toner ejecting port 49 and the second toner ejecting port 55 in an opposed relation, as shown in FIG. 5(*a*). At this time, each of the second radial projections 57 contacts with the lower end edge of the corresponding upper guide groove 129, each of the third radial projections 63 contacts with the lower end edge of each of the corresponding lower guide groove 130, and each of the lateral projections 54 contacts with the rear end edge of the corresponding insertion groove 127.

In the inner casing 42, a positively chargeable nonmagnetic single-component toner is contained as an example of a developing agent. As the toner, a polymerized toner is used. The polymerized toner is obtained by copolymerizing polymerizable monomers, for example, styrene monomers such as styrene, and acrylic monomers such as acrylic acid, alkyl (C1 to C4) acrylate, and alkyl (C1 to C4) methacrylate through suspension polymerization and the like. The polymerized toner is generally in spherical shape, extremely excellent in fluidity, and can achieve high quality image formation.

In such toner, a coloring agent such as carbon black or wax is mixed. Additionally, an additive agent such as silica is added to improve the fluidity. The toner has an average particle size of approximately 6 to 10 μm.

(b-4) Attaching and Detaching of Toner Box to and from Process Unit (b-4-i) Attaching of Toner Box to Process Unit To the toner box accommodation chamber 71 of the process unit 20 which is in a state where the open/close lever 113 is in the release position and the shutter 111 is in the developer closing position, as shown in FIG. 8, the toner box 40 in which inner casing 42 is in the toner blocking position is attached from the obliquely upper front side to the obliquely lower rear side. At this time, as shown in FIG. 6, each of the positioning projections 131 of the toner box 40 is guided to the corresponding guide groove 119 of the toner box accommodation chamber 71 of the process unit 20. Further, the swinging member 92 of the toner box 40 is in the first state and the pivot of the inner casing 42 with respect to the outer casing 41 is restricted.

When each of the positioning projections 131 reaches the deepest portion of the corresponding guide groove 119 and is brought into contact with the deepest portion, each of the lateral projections 54 of the toner box 40 is engaged with the corresponding receiving portion 117 of the open/close lever 113 in the release position, as shown in FIG. 7. At this time, as shown in FIG. 9, each of the second radial projections 57 of the toner box 40 engages with the corresponding engaged portion 139 of the shutter 111 of the toner box accommodation chamber 71, and the shutter 111 is sandwiched by the corresponding second radial projection 57 and third radial projection 63 in the direction of the pivot thereof. At this time, as with the second radial projection 57, each of the third radial projections 63 engages with the shutter 111. The swinging member 92 is in the third state (see FIG. 10) when the second engaging portion 133 engages to the engagement portion 124.

The positioning rib 137 of the toner box 40 is fitted in the positioning groove 138 of the process unit 20 and engages with the developer casing 62, as shown in FIG. 7. In this manner, in the toner box 40, the outer casing 41 is positioned widthwise with respect to the toner box accommodation chamber 71, and the attaching of the toner box 40 to the process unit 20 is completed. In this state, the grip portion 118 of the open/close lever 113 at the release position, is spaced apart at a predetermined interval in relation to the toner box side grasp portion 91 of the toner box 40 under the toner box side grasp portion 91, as shown in FIG. 9. Moreover, the contacting portion 143 of each contacting projection 141 of the process unit side grasp portion 110 is opposed to and slightly contacts with the guide surface 146 of each of the corresponding contact members 142 in the toner box 40, as shown in FIG. 11(*b*).

As shown in FIG. 7, in a state where the toner box 40 is completely mounted in the process unit 20, the swinging member 92 is in the third state as described above, and thus the inner casing 42 is pivotable in relation to the outer casing 41. Thus when the open/close lever 113 is pivoted from the release position to the contacting position (see FIG. 2), the inner casing 42 pivots from the toner closing position (see FIG. 10) to the toner opening position (see FIG. 3) in conjunction with the pivot of the open/close lever 113 (process unit side grasp portion 110). Accordingly, the first toner ejecting port 49 and the second toner ejecting port 55 are opposed, as shown in FIG. 3. On the other hand, in conjunction with the pivot of the inner casing 42, the shutter 111, which is sandwiched by the second radial projections 57 and the third radial projections 63 of the inner casing 42, pivots from the developer closing position (see FIG. 9) to the developer opening position, and the penetration hole 112 of the shutter 111 and the toner guiding port 88 of the toner box accommodation chamber 71 are opposed to each other. Further, along with the pivot of the open/close lever 113 from the release position to the contacting position, the process unit side grasp portion 110 pivots upward, whereby the grip portion 118 is adjacent to the toner box side grasp portion 91.

In the toner box accommodation chamber 71 in which the shutter 111 is at the developer opening position, and in the toner box 40 in which the inner casing 42 is at the toner opening position, the penetration hole 112 and the toner guiding port 88 which are in the opposed state in the toner box accommodation chamber 71, and the first toner ejecting port 49 and the second toner ejecting port 55 which are in the opposed state in the toner box 40, are opposed and communicate to each other. As a result, the internal portion of the inner casing 42 of the toner box 40 and the internal portion of the developing chamber 72 of the developing section 30 communicate to each other via the toner guiding port 88, the penetration hole 112, the first toner ejecting port 49 and the second toner ejecting port 55.

As described above, since a space between the outer casing 41 where the first toner ejecting port 49 is formed and the inner casing 42 where the second toner ejecting port 55 is formed, is kept in air-tight and fluid-tight manner by the first radial projection 48, and further, since the seal member 125 is interposed in a space between the shutter 111 where the penetration hole 112 is formed and the curved wall 122 where the toner guiding port 88 is formed, the toner is prevented from leaking off to the outside from the toner guiding port 88, the penetration hole 112, the first toner ejecting port 49, and the second toner ejecting port 55.

As described above, when the process unit side grasp portion 110 pivots along with the pivot of the open/close lever 113 from the release position to the contacting position, the contacting portion 143 of each of the contacting projections 141 of the process unit side grasp portion 110 passes the guide surface 146 of the contact member 142, and then pivots upward along the contact surface 147 and goes over the plurality of contact portions 144, as shown in FIG. 11(*a*).

Since the contacting portion 143 is formed in a convex shape and the contact portion 144 is formed in a concave shape, a vibration is generated when the contacting portion 143 goes over the contact portion 144, and the vibration is then given to the inner round wall 51 and the shutter 111. In other words, the contacting portion 143 and the contact portion 144 serve as an example of a vibration applying unit.

When the pivot of the open/close lever 113 to the contacting position is completed, the contacting portion 143 of the process unit side grasp portion 110 engages with the contact portion 144 at the uppermost position. At this time, the contacting portion 143 abuts against each of the contact members 142 from the front side thereof with a contact pressure higher than that in the case where the open/close lever 113 is at the release position (see FIG. 11(*b*)). The term "abut" is distinct from the term "contact" at the release position. Similarly, the contacting projection 141 also abuts (contacts with high pressure) against the contact member 142.

Figure 13:
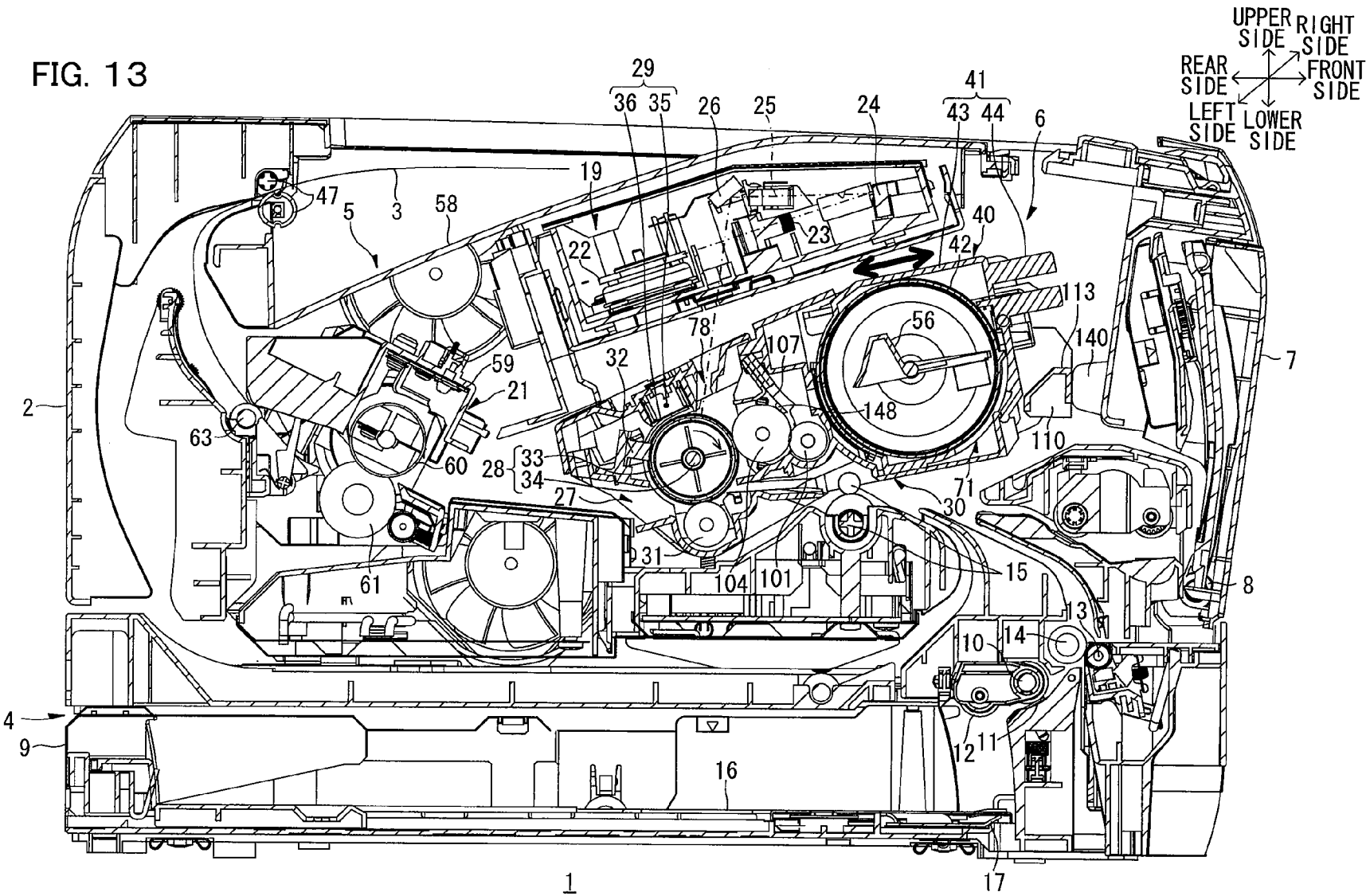
FIG. 13 is a side sectional view of the laser printer shown in FIG. 1, showing a state where the open/close lever interferes with a front cover in the midway of closing a mounting port.

FIG. 13 is a side sectional view of the laser printer shown in FIG. 1, showing a state where the open/close lever interferes with the front cover in the midway of closing the mounting port.

When the process unit 20 is attached in the main body casing 2 and the open/close lever 113 is at the contacting position, a space is formed below the process unit side grasp portion 110 as shown in FIG. 1. When the front cover 7 is closed to close the mounting port 6 in this state, the intervening portion 140 of the front cover 7 is accommodated in the space described above. On the other hand, when the open/close lever 113 is at the position other than the contacting position, the process unit side grasp portion 110 is disposed in this space as shown in FIG. 13, and therefore, in the midway of closing the front cover 7, the intervening portion 140 contacts with the process unit side grasp portion 110. In other words, the open/close lever 113 interferes with the front cover 7 in the midway of closing the mounting port 6 in the case other than the case of being located in the contacting position.

(b-4-ii) Detaching of Toner Box from Process Unit

In a state where the shutter 111 is in the developer opening position and the inner casing 42 is in the toner opening position, the open/close lever 113 which is in the contacting position is pivoted to the release position as shown in FIG. 10. In conjunction with the pivot of the open/close lever 113 (process unit side grasp portion 110), the inner casing 42 pivots from the toner opening position to the toner closing position, and the second toner ejecting port 55 of the inner round wall 51 is blocked by a portion of the outer round wall 45 in the outer casing 41 other than the first toner ejecting port 49, to seal the internal portions of the outer casing 41 and the inner casing 42. On the other hand, in conjunction with the pivot of the inner casing 42, the second radial projections 57 and the third radial projections 63 pivot, and the shutter 111 which is sandwiched by the second radial projections 57 and the third radial projections 63 pivots from the developer opening position to the developer closing position. In this manner, the toner guiding port 88 of the toner box accommodation chamber 71 is blocked by a portion of the shutter 111 other than the penetration hole 112.

Further, along with the pivot of the open/close lever 113 to the release position, the process unit side grasp portion 110 pivots downward, and therefore, the contacting portion 143 of the process unit side grasp portion 110 goes over the plurality of contact portions 144 while pivoting downward along the contact surface 147, as shown in FIG. 11(*b*). The vibration described above is generated when the contacting portion 143 goes over the contact portion 144. When the pivot of the open/close lever 113 to the release position is completed, the contacting portion 143 is opposed to and slightly contacts the guide surface 146. In other words, the abutting (contacting with high pressure) state of the contacting portion 143 to the contact member 142 is released when the open/close lever 113 is at the release position.

In a state where the open/close lever 113 is pivoted to an release position, since the first restricting portion 94 is in the third state and the second engaging portion 133 engages with the engagement portion 124, as shown in FIG. 10, the swinging member 92 is pivoted to the second state and the engagement between the second engaging portion 133 and the engagement portion 124 is released, as shown in FIG. 9. While the swinging member 92 is remained in the second state (the swinging member 92 is kept held), the toner box 40 is drawn out obliquely upwardly forward from the toner box accommodation chamber 71. At this time, each of the positioning projections 131 (see FIG. 6) of the toner box 40 is guided to the corresponding guide groove 119 (see FIG. 6) in the toner box accommodation chamber 71. When the toner box 40 which has been drawn out is released, the swinging member 92 comes to the first state (see FIG. 8).

When each of the positioning projections 131 comes off from the corresponding guide groove 119, the engagement between each of the lateral projections 54 and the corresponding receiving portion 117 is released (see FIG. 7), and the engagement between each of the second radial projections 57 and the corresponding engagement portion 139 is released, the detaching of the toner box 40 from the process unit 20 is completed.

(b-5) Developing and Transferring Operation

As described in (b-4-i) above and as shown in FIG. 3, after the toner box 40 is attached to the process unit 20 and accommodated in the toner box accommodation chamber 71, a driving force from a motor (not shown) is input to the agitator rotating shaft 53 at an image forming by the laser printer 1. Then, the agitator rotating shaft 53 is rotated in clockwise direction as viewed from left and the agitator 56 moves about the agitator rotating shaft 53 in circumferential direction in the internal space of the inner casing 42 of the toner box 40. Therefore, the toner in the toner box 40 is stirred by the agitator 56, supplied to the developing section 30 through the second toner ejecting port 55 and the first toner ejecting port 49, received in the penetration hole 112 and the toner guiding port 88, and then released into the developing chamber 72. In accordance with the rotation of the agitator rotating shaft 53, each of the aforedescribed wipers 50 of the agitator 56 wipes a toner detecting window (not shown) provided in the corresponding inner side edge wall 52 of the inner casing 42, thereby cleaning the toner detecting windows (not shown) by the wipers 50.

The toner released from the toner guiding port 88 into the developing chamber 72 is supplied to the developing roller 104 by the rotation of the feed roller 101. At this time, the toner is triboelectrically positively charged between the feed roller 101 and the developing roller 104. In accordance with the rotation of the developing roller 104, the toner supplied onto the developing roller 104 enters between the pressing member 148 of the layer-thickness regulating blade 107 and the rubber roller 106 of the developing roller 104, and are carried as a thin layer with a uniform thickness on the developing roller 104.

In accordance with the rotation of the photosensitive drum 28, the surface of the photosensitive drum 28 is uniformly positively charged by the scorotron charger 29, and then exposed by laser beams of high-speed scanning from the scanning section 19, and finally an electrostatic latent image which corresponds to the image to be formed on the sheet, 3 is formed.

Thereafter, by the rotation of the developing roller 104, the toner which is carried on the developing roller 104 and positively charged, opposingly contacts with the photosensitive drum 28. At this time, the toner is supplied to the electrostatic latent image formed on the surface of the photosensitive drum 28, that is, a portion exposed by laser beams and has lower potential on the surface of the uniformly positively charged photosensitive drum 28. Consequently, the electrostatic latent image on the photosensitive drum 28 is visualized and the toner image by reversal developing is carried on the surface of the photosensitive drum 28.

After that, the toner image carried on the surface of the photosensitive drum 28 is transferred on the sheet 3 which is transported by the resist roller 15 (see FIG. 1) and enters from the first passing port 84 into the drum casing 76. During the passage of the sheet 3 through a transfer position between the photosensitive drum 28 and the transfer roller 31, the toner image is transferred onto the sheet 3 by transfer bias applied on the transfer roller 31.

The sheet 3 having a transferred toner image is ejected from the second passing port 85 to the outside of the drum casing 76 and transported to the fixing section 21.

The toner remaining on the photosensitive drum 28 after the transfer is recovered by the developing roller 104.

(c) Fixing Section

The fixing section 21 is provided in back of the process unit 20 and disposed in generally anteroposteriorly spaced relation to the photosensitive drum 28 of the process unit 20, as shown in FIG. 1. The fixing section 21 includes a fixing frame 59, and a heating roller 60 and a pressure roller 61 in the fixing frame 59.

In the fixing section 21, the toner image which has been transferred onto the sheet 3 in the transfer position, is thermally fixed on the sheet 3 when the sheet 3 passes between the heating roller 60 and the pressure roller 61. The sheet 3 fixed with the toner image is transported to the sheet ejecting transport path and then transported to a sheet ejecting roller 47 by a transport roller 63, and is finally ejected onto a sheet ejection tray 58 by the ejecting roller 47. The sheet ejection tray 58 is formed on the upper surface of the main body casing 2.

2. Operations and Effects of the Embodiment

As described above, in the process unit 20, the process unit side grasp portion 110 disposed at the open/close lever 113 of the developing section 30 abuts (contacts with high pressure) against the toner box 40 from the front side (downstream side in the detaching direction of the toner box 40 from the developing section 30) as shown in FIG. 2. Therefore, even when a force to move the toner box 40 forward (in a detaching direction) is applied to the toner box 40, the forward relative movement of the toner box 40 on the front side of the toner box 40 in relation to the developing section 30 can be restricted.

As a result, the attached state of the toner box 40 in the developing section 30 can reliably be maintained.

As shown in FIG. 11, the open/close lever 113 can pivot between a contacting position (see FIG. 11(*a*)) where the process unit side grasp portion 110 abuts (contacts with high pressure) against the toner box 40 attached in the developing section 30, and an release position (see FIG. 11(*b*)) where the abutment (contact with high pressure) of the process unit side grasp portion 110 against the toner box 40 is released. Therefore, a simple operation of pivoting the open/close lever 113 can reliably maintain the attached state of the toner box 40 in the developing section 30 (see FIG. 2) when the open/close lever 113 is in the contacting position. On the other hand, when the open/close lever 113 is in the release position, the attached state which has been maintained can be released and the toner box 40 can be attached to and detached the developing section 30 (see FIG. 6).

Moreover, since in the detached state of the toner box 40 from the developing section 30, the open/close lever 113 is located at the release position below the contacting position by its own weight, the process of moving the open/close lever 113 to the release position can be eliminated when attaching the toner box 40 to the developing section 30, as shown in FIG. 8.

Moreover, in the toner box 40, the second toner ejecting port 55 is opened by pivoting the inner casing 42 to the toner opening position to open the outer round wall 45 (see FIG. 5(*a*)), and in the developing section 30, the shutter 111 is moved to the developer opening position and opened to release the toner guiding port 88 (see FIG. 4(*a*)), so that the second toner ejecting port 55 and the toner guiding port 88 are communicated with each other, as shown in FIG. 3 thereby supplying the toner from the toner box 40 to the developing section 30. On the other hand, in the toner box 40, the inner casing 42 is pivoted to the toner closing position and closed to close the outer round wall 45 (see FIG. 10), so that the second toner ejecting port 55 is closed, and in the developing section 30, the shutter 111 is moved to the developer closing position (see FIG. 4(*b*)) and closed so that the toner guiding port 88 is closed whereby supplying of the toner from the toner box 40 to the developing section 30 can be restricted.

Additionally, the opening and closing operation of the outer round wall 45 and the shutter 111, that is, the pivot of the inner casing 42 and the movement of the shutter 111 interlock with the pivot movement of the open/close lever 113. Therefore, the pivot of the open/close lever 113 can maintain (see FIG. 2) or release (see FIG. 7) the attached state of the toner box 40 in the developing section 30, and further, can supply the toner from the toner box 40 to the developing section 30 (see FIG. 3) or can restrict the supplying of the toner (see FIG. 10), thus achieving improvement in the operability.

Moreover, the contacting portion 143 and the contact portion 144 shown in FIG. 11 give vibration to at least the outer round wall 45 at the time of pivot movement of the open/close lever 113. The vibration can shake off the toner that adheres to the outer round wall 45 at the time of opening and closing of the outer round wall 45 that interlocks with the pivot movement of the open/close lever 113.

Specifically, the vibration is generated at the time of pivot movement of the open/close lever 113 when the contacting portion 143 formed in a convex shape contacts with the contact portion 144 formed in a concave shape. Alternatively, the contacting portion 143 may be formed in a concave shape and the contact portion 144 may be formed in a convex shape. The contacting portion 143 and the contact portion 144 formed in a convex shape or in a concave shape allow a simple configuration of the vibration applying unit while reliably generating the vibration. While the plurality of contact portions 144 are provided in FIG. 11, only one contact portion is provided in FIG. 12. When the plurality of contact portions 144 are provided, greater vibration can be generated between the contact portion 144 and the contacting portion 143.

Moreover, as shown in FIG. 2, when the open/close lever 113 pivots to the contacting position, the grip portion 118 of the open/close lever 113 is located adjacent to the toner box side grasp portion 91 of the toner box 40, so that the grip portion 118 and the toner box side grasp portion 91 can be held together. This stabilizes the relative position of the developing section 30 provided with the open/close lever 113 and the toner box 40, and thus stabilizes the movement of the process unit 20.

Moreover, in the attached state of the developing section 30 and the toner box 40 in the main body casing 2, the open/close lever 113 interferes with the front cover 7 in the midway of closing the mounting port 6 in cases other than a case where the open/close lever 113 is located at the contacting position (see FIG. 1), as shown in FIG. 13. Accordingly, undesired operations of the laser printer 1 can be prevented when the toner box 40 is not attached properly in the developing section 30 (or when the open/close lever 113 is not located in the contacting position).

Moreover, as shown FIG. 7, when the open/close lever 113 is in the contacting position (see FIG. 3), the contacting projections 141 that abuts (contacts with high pressure) against the contact members 142 of the toner box 40, are disposed at both end portions of the process unit side grasp portion 110 in the width direction, that is, the longitudinal direction. The contact members 142 are provided at both end portions of the toner box 40 in the width direction.

The contacting projection 141 thus abuts (contacts with high pressure) against the contact member 142 at both longitudinal end portions of the process unit side grasp portion 110 when the open/close lever 113 is in the contacting position, thereby preventing the deflection of the process unit side grasp portion 110 and the open/close lever 113, and thus preventing the deformation of the process unit side grasp portion 110 and the open/close lever 113, to improve the durability thereof.

The toner box side grasp portion 91 can be separated from the contact member 142 since the toner box side grasp portion 91 is disposed between the contact members 142 which are disposed at both end portions in the width direction in the toner box 40, thereby preventing the interference of hand with the contact member 142 when holding the toner box side grasp portion 91 by the hand.

A positioning rib 137 is provided between the contact member 142 and the toner box side grasp portion 91 in the width direction in the toner box 40. The positioning rib 137 engages with the developer casing 62 when the toner box 40 is attached to the developing section 30, positioning the toner box 40 in the width direction.

Accordingly, the contact member 142 does not shift in the width direction when the toner box 40 is attached to the developing section 30, and thus the contacting projection 141 can reliably abut (contact with higher pressure) against the contact member 142 when the open/close lever 113 is in the contacting position. Moreover, as described above, the contact members 142 are provided at both end portions of the toner box 40 in the width direction and thus the deflection of the process unit side grasp portion 110 is prevented when the contacting projection 141 abuts (contacts with higher pressure) against the contact member 142. Therefore, the positioning rib 137 provided between the contact members 142 in the width direction does not shift, and the toner box 40 can reliably be positioned.

Further, in the open/close lever 113, the process unit side grasp portion 110 is configured so as to connect the free end (front end portion) of the right support portion 108 and the free end (front end portion) of the left support portion 109, thereby improving the strength of the open/close lever 113.

The open/close lever 113 engages with the lateral projection 54, so that the second toner ejecting port 55 pivots together with the lateral projection 54. Therefore, the outer round wall 45 pivots relatively with respect to the second toner ejecting port 55, as shown in FIG. 3. On the other hand, the shutter 111 engages with the second radial projection 57 and the third radial projection 63 which pivot together with the lateral projection 54 with respect to the outer round wall 45, whereby the shutter 111 pivots. This achieves reliable pivot of the outer round wall 45 and the shutter 111 and thus achieves reliable opening and closing of the second toner ejecting port 55 and the toner guiding port 88.

Second Embodiment

In the first embodiment described above, the process unit 20 integrally includes the drum section 27 and the developing section 30, and the process unit 20 is detachably attached to the main body casing 2. In addition to this, for example, the developing section 30 may be detachably attached to the drum section 27.

In the description above, two independent embodiments of the first embodiment and the second embodiment to be applied with one or more aspects of the present invention, have been described in detail. However, it should be noted that one skilled in the art may optionally combine the gist of these two embodiments and provide a process unit, a toner box and an image forming apparatus having advantages described above in relation to the two embodiments.

The embodiments described above are illustrative and explanatory of the invention. The foregoing disclosure is not intended to be precisely followed to limit one or more aspects of the present invention. Various modifications and alterations are possible in light of the foregoing description, and may be obtained by implementing the invention. The present embodiments are selected and described for explaining the essence and practical applicational schemes of one or more aspects of the present invention which allow those skilled in the art to utilize one or more aspects of the present invention in various embodiments and various alterations suitable for anticipated specific use. The scope of the present invention is to be defined by the appended claims and their equivalents.

What is claimed is:

1. A process unit including:

a unit main body being detachably mountable to an image forming apparatus main body and having a developer carrier for supplying a developing agent to an image carrier on which an electrostatic latent image is formed;

a toner box being detachably mountable to the unit main body and accommodating the developing agent;

a pivoting member pivotably disposed at the unit main body and including a first arm and a second arm; and a contacting member connecting a free end of the first arm and a free end of the second arm and contacting with the toner box from a downstream side in a detaching direction of the toner box from the unit main body.

2. The process unit according to claim 1, wherein the pivoting member can pivot between a contacting position where the contacting member contacts with the toner box attached in the unit main body, and a release position where contact of the contacting member with the toner box is released.

3. The process unit according to claim 2, wherein the release position is located below the contacting position, and the pivoting member is located at the release position by its own weight in a state where the toner box is detached from the unit main body.

4. The process unit according to claim 2, wherein the unit main body includes an accommodating section for accommodating the toner box in a detachably mountable manner, the accommodating section including a first wall located at one end of the toner box in a longitudinal direction, and a second wall located at the other end of the toner box in a longitudinal direction, the first arm is pivotably supported on the first wall and extending toward the downstream side of the detaching direction of the toner box, and the second arm is pivotably supported on the second wall and extending toward the downstream side of the detaching direction of the toner box.

5. The process unit according to claim 2, wherein the toner box includes a first casing formed with a first opening for supplying the developing agent to the unit main body, and a first blocking member for opening and closing the first opening, the unit main body includes a second casing formed with a second opening which is opposed to the first opening and is for receiving the developing agent supplied from the first opening when the toner box is attached in the unit main body, and a second blocking member for opening and closing the second opening, and a pivot movement of the pivoting member interlocks with an open and close movement of at least one of the first blocking member and the second blocking member.

6. The process unit according to claim 5, wherein the first casing includes:

a first engaging portion engaged with the pivoting member and pivoting together with the first opening with respect to the first blocking member; and a second engaging portion engaged with the second blocking member and pivoting together with the first engaging member with respect to the first blocking member.

7. The process unit according to claim 6, further including a vibration applying unit for applying vibration to at least the first blocking member at a time of pivot movement of the pivoting member.

8. The process unit according to claim 7, wherein the vibration applying unit including:

a first portion formed in a convex or concave shape in the contacting member and contacting with the toner box at a time of pivot movement of the pivoting member; and a second portion formed in a concave shape in case the first portion is in a convex shape and formed in a convex shape in case the first portion is in a concave shape in the toner box and contacted with by the first portion at a time of pivot movement of the pivoting member.

9. The process unit according to claim 5, wherein the pivoting member includes a first grasp portion and the toner box includes a second grasp portion, and the first grasp portion is located adjacent to the second grasp portion when the pivoting member pivots to the contacting position.

10. The process unit according to claim 9, including:

a first part disposed at both end portions in a longitudinal direction of the contacting member and contacting with the toner box when the pivoting member is in the contacting position; and a second part disposed at both end portions in the longitudinal direction of the toner box and contacted with by the first part when the pivoting member is in the contacting position.

11. The process unit according to claim 10, wherein the second grasp portion is disposed between the second part disposed on the both end portions in the longitudinal direction.

12. The process unit according to claim 11 including a positioning portion which is provided between the second part and the second grasp portion in the longitudinal direction in the toner box and positions the toner box in the longitudinal direction by engaging with the second casing when the toner box is attached to the unit main body.

13. An image forming apparatus including:

an image forming apparatus main body; and a process unit detachably mountable to the image forming apparatus main body, wherein the process unit includes:

a unit main body being detachably mountable to the image forming apparatus main body and having a developer carrier for supplying a developing agent to an image carrier on which an electrostatic latent image is formed;

a toner box being detachably mountable to the unit main body and accommodating the developing agent;

a pivoting member pivotably disposed at the unit main body; and a contacting member disposed at the pivoting member and contacting with the toner box from a downstream side in a detaching direction of the toner box from the unit main body, the pivoting member can pivot between a contacting position in which the contacting member contacts with the toner box attached in the unit main body and a release position in which contact of the contacting member with the toner box is released, the image forming apparatus main body is formed with an opening for passing the process unit therethrough and has a cover for covering the opening in an openable and closable manner, and the pivoting member interferes with the cover when the opening is closed by the cover in a state where the unit main body and the toner box are attached in the image forming apparatus main body in cases other than a case where the pivoting member is located at the contacting position.

14. A toner box detachably mountable to a unit main body including a developer carrier and accommodating a developing agent, including:

a first casing formed with a first opening for supplying the developing agent to the unit main body;

a first blocking member for opening and closing the first opening; and a vibration applying unit for applying vibration to the first blocking member at a time of opening and closing of the first blocking member;

wherein the vibration applying unit includes a plurality of contact portions formed in a convex or concave shape and the contact portions are arranged along a designated direction.

15. A process unit including:

a unit main body being detachably mountable to an image forming apparatus main body and having a developer carrier for supplying a developing agent to an image carrier on which an electrostatic latent image is formed;

a toner box being detachably mountable to the unit main body and accommodating the developing agent;

a pivoting member provided at the unit main body and being pivotable; and a contacting member provided at the pivoting member, disposed with respect to the toner box attached in the unit main body on a downstream side in a detaching direction of the toner box from the unit main body, and contacting with the toner box toward a general center of the toner box from the downstream side in the detaching direction.

* * * * *